US012704291B2

(12) United States Patent
Kurino et al.

(10) Patent No.: US 12,704,291 B2
(45) Date of Patent: Aug. 11, 2026

(54) OUTDOOR UNIT, AND REFRIGERATION CYCLE DEVICE

(71) Applicant: Mitsubishi Electric Corporation, Tokyo (JP)

(72) Inventors: Hayato Kurino, Tokyo (JP); Hiroyuki Jinnai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 63 days.

(21) Appl. No.: 18/832,794

(22) PCT Filed: May 26, 2022

(86) PCT No.: PCT/JP2022/021482

§ 371 (c)(1),
(2) Date: Jul. 24, 2024

(87) PCT Pub. No.: WO2023/228339

PCT Pub. Date: Nov. 30, 2023

(65) Prior Publication Data

US 2025/0297769 A1 Sep. 25, 2025

(51) Int. Cl.
*F24F 13/22* (2006.01)

(52) U.S. Cl.
CPC ..... *F24F 13/222* (2013.01)

(58) Field of Classification Search
CPC ..... F24F 13/222; F24F 1/56; F24F 1/36
See application file for complete search history.

(56) References Cited

U.S. PATENT DOCUMENTS

2017/0363303 A1* 12/2017 Jinnai ..... F24F 1/22
2022/0018580 A1* 1/2022 Kim ..... F24F 11/36
(Continued)

FOREIGN PATENT DOCUMENTS

JP H08-094125 A 4/1996
JP 2001-317766 A 11/2001
(Continued)

OTHER PUBLICATIONS

International Search Report of the International Searching Authority mailed Jul. 19, 2022 in corresponding International Application No. PCT/JP2022/021482 (and English translation).
(Continued)

*Primary Examiner* — Nelson J Nieves
(74) *Attorney, Agent, or Firm* — Posz Law Group, PLC

(57) ABSTRACT

An outdoor unit includes a housing having first and second rooms; a heat exchanger and a blower inside of the first room; and controlling circuitry inside the second room, wherein a drain water hole is formed on a bottom of the first room; a flow path portion thereof is connected and is formed so as to straddle bottoms of the rooms and supports support a partitioning member, are formed on the bottom of the housing. An inbetween flow path portion between the pair of supports of the drain water flow path portion, where the partitioning member has a facing member facing a bottom surface thereof via a gap, and a step portion is formed on a the bottom surface of the inbetween flow path portion so that a side farther from the drain water hole is higher than a side closer thereto, in an extension direction thereof, as seen from the top.

10 Claims, 18 Drawing Sheets

(56) References Cited

U.S. PATENT DOCUMENTS

| | | | | |
|---|---|---|---|---|
| 2022/0205653 | A1* | 6/2022 | Yamauchi | F24F 1/36 |
| 2022/0307706 | A1* | 9/2022 | Shen | F24F 1/0083 |
| 2023/0119292 | A1* | 4/2023 | Kataoka | F24F 11/32<br>382/100 |
| 2023/0358591 | A1* | 11/2023 | Coughlan | G01F 23/268 |

FOREIGN PATENT DOCUMENTS

| | | | |
|---|---|---|---|
| JP | 3523823 | B | 4/2004 |
| JP | 2005-055128 | A | 3/2005 |
| JP | 2011-106756 | A | 6/2011 |
| JP | 2014-043977 | A | 3/2014 |
| WO | 01/65184 | A2 | 9/2001 |

OTHER PUBLICATIONS

Office Action issued on Jan. 28, 2026 in corresponding Turkish Patent Application No. 2024/012138 (and English machine translation).

* cited by examiner

OUTDOOR UNIT, AND REFRIGERATION CYCLE DEVICE

CROSS-REFERENCE TO RELATED APPLICATION

This application is a U.S. National Stage Application of International Application No. PCT/JP2022/021482 filed May 26, 2022, the contents of which are incorporated herein by reference.

TECHNICAL FIELD

The present disclosure relates to an outdoor unit, and a refrigeration cycle device.

BACKGROUND

For example, as shown in Patent Document 1, an outdoor unit having a drain water path formed so as to drain water from condensation or the like on a bottom plate of a housing is known.

PATENT DOCUMENT

[Patent Document 1] Japanese Patent No. 3523823

There is a risk of small creatures such as pests and insects or the like from entering through a drain water flow path to an inside of a mechanical room thereof, in the aforementioned outdoor unit. In Patent Document 1 for example, although a step is formed on a bottom plate, in order to suppress water from condensation or the like from flowing to an outside of a mounting surface of a heat exchanger, by simply providing a step, it is still difficult to suppress small creatures from entering to the inside of the mechanical room.

SUMMARY

The present disclosure has been made in order to address the aforementioned problem, and an object is to provide an outdoor unit having a structure that does not allow small creatures to enter to the inside of the mechanical room, and to provide a refrigeration cycle device that includes such outdoor unit.

An outdoor unit according to an embodiment of the present disclosure, is an outdoor unit of a refrigeration cycle device that includes a housing having a first room and a second room that are partitioned from one another by a partitioning member; a heat exchanger disposed on an inside of the first room; a blower that is disposed on the inside of the first room, and controlling circuitry that is disposed on an inside of the second room, wherein on a bottom of the housing a drain water hole that is formed on a bottom of the first room; a drain water flow path portion that is connected to the drain water hole, and that is formed so as to straddle between the bottom of the first room and the bottom of the second room, and a pair of supports that support the partitioning member from a bottom side in a vertical direction, are formed on the bottom of the housing, the drain water flow path portion has an inbetween flow path portion that is located between the pair of supports, the partitioning member has a facing member that faces a bottom surface of the inbetween flow path portion via a gap on a top side in a vertical direction, and a step portion is formed on a bottom surface of the inbetween flow path portion so as to have a side that is farther from the drain water hole be higher than a side that is closer to the drain water hole, in an extension direction in which the inbetween flow path portion extends in, as seen from the top side in the vertical direction, and a flow path width of the inbetween flow path portion is smaller than: a maximum flow path width that is connected to a downstream side of the inbetween flow path portion, out of the drain water flow path portion, and a flow path width that is connected to an upstream side of the inbetween flow path portion, out of the drain water flow path portion.

An embodiment of the refrigeration cycle device according to the present disclosure includes an outdoor unit, and an indoor unit.

According to the present disclosure, it is possible to suppress small creatures from entering to an inside of a mechanical room, in an outdoor unit of a refrigeration cycle device.

DETAILED DESCRIPTION

Figure 1:
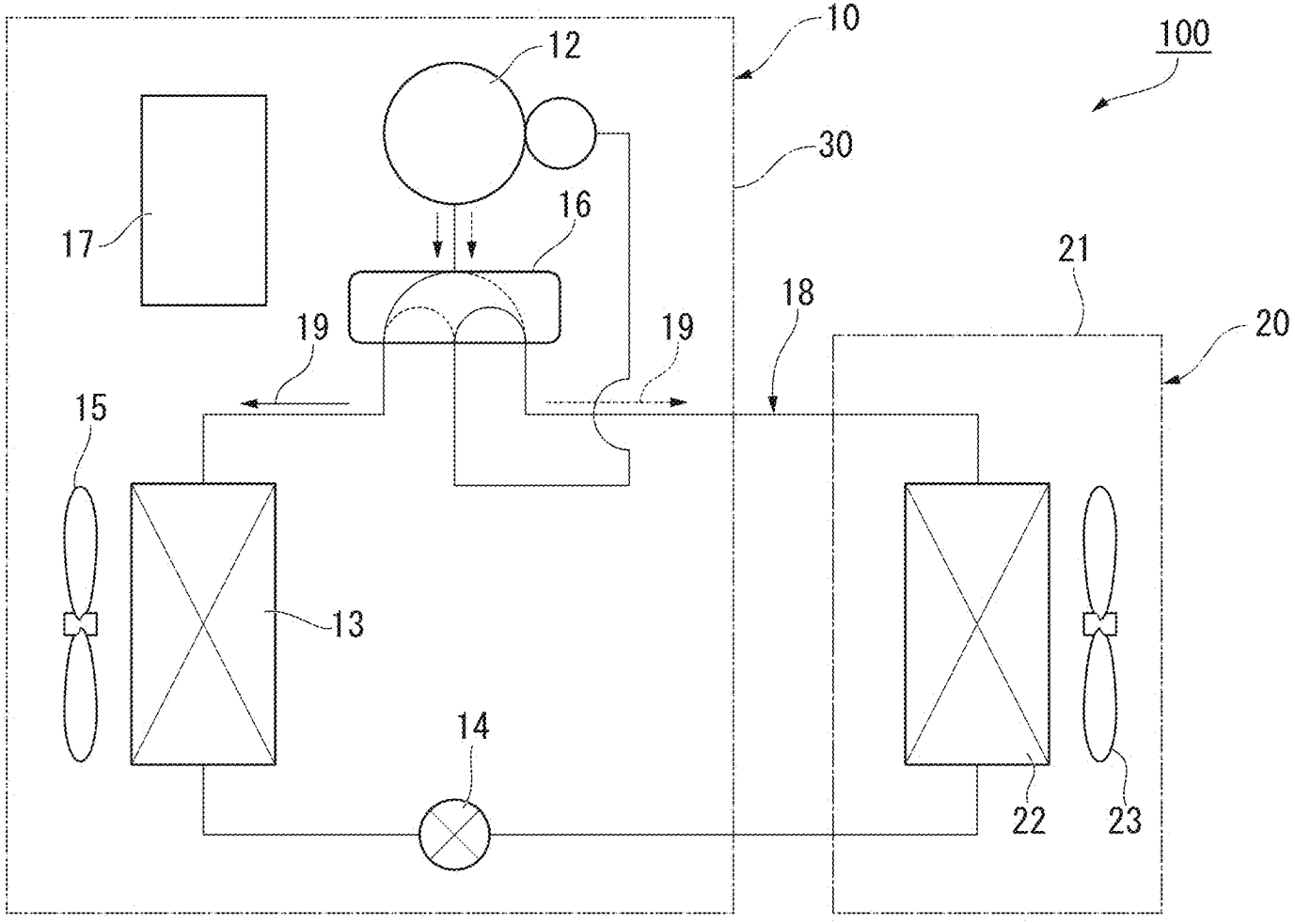
FIG. 1 A schematic view that shows an outline configuration of a refrigeration cycle device, in a first embodiment.

Hereinafter, an embodiment of the present disclosure is explained with reference to the drawings. The scope of the present disclosure is not limited to the embodiment below, and may be changed so long as the embodiment do not depart from the technical scope of the present disclosure. In the drawings below, scales and dimensions of various configurations may differ from scales and dimensions in the drawings below, to facilitate better understanding of the various embodiments.

The drawings show an X axis, a Y axis, and a Z axis where appropriate. The X axis shows a side out of sides of a horizontal direction. The Y axis shows another side out of sides of the horizontal direction. The Z axis shows a vertical direction. In the explanation below, a horizontal direction along the X axis is referred to as a "front-rear direction X", and a horizontal direction along the Y axis is referred to as a "left-right direction Y". A vertical direction is referred to as a "vertical direction Z". The front-rear direction X, the left-right direction Y, and the vertical direction Z are mutually orthogonal directions. In the explanation below, a side out of sides of the vertical direction Z in which an arrow of the Z axis faces is a top side (+Z side). The other side out of sides of the vertical direction Z which faces an opposite side the arrow of the Z axis faces is a bottom side (−Z side). A side out of sides of the front-rear direction X in which an arrow of the X axis faces is a front side (+X side). A side out of sides of the front-rear direction X which faces an opposite side the arrow of the X axis faces is a rear side (−X side). The left-right direction Y in the embodiment below, is the left-right direction Y in a case where an outdoor unit is viewed from the front side (+X side). In other words, a side out of sides of the left-right direction Y in which an arrow of the Y axis faces is a right side (+Y side). A side out of sides in the left-right direction Y which faces an opposite side the arrow of the Y axis faces is a left side (−Y side).

First Embodiment

FIG. 1 is a schematic view that shows an outline configuration of a refrigeration cycle device 100 in a first embodiment. The refrigeration cycle device 100 is a device that uses a refrigeration cycle in which a refrigerant 19 is circulated. The refrigeration cycle device 100 in the first embodiment is an air conditioner. As shown in FIG. 1, the refrigeration cycle device 100 includes the outdoor unit 10, an indoor unit 20, and a circulation path 18. The outdoor unit 10 is disposed outdoors. The indoor unit 20 is disposed indoors. The outdoor unit 10 and the indoor unit 20 are connected by the circulation path 18 that circulates a refrigerant 19. The outdoor unit 10 and the indoor unit 20 are heat exchange units that conduct heat exchange with air.

By having the refrigerant 19 that flows within the circulation pathway 18, and the indoor unit 20 conduct heat exchange with air indoors, it is possible for the air conditioner 100 to adjust a temperature of the air indoors. A refrigerant such as a fluorine based refrigerant with a low global warming potential (GWP: Global Warming Potential), or a hydrocarbon based refrigerant or the like may be mentioned as examples of the refrigerant 19.

The outdoor unit 10 includes a housing 30, a compressor 12, a heat exchanger 13, a flow adjustment valve 14, a blower 15, a four-way valve 16, and controlling circuitry 17. The compressor 12, the heat exchanger 13, the flow adjustment valve 14, the blower 15, the four-way valve 16, and the controlling circuitry 17 are housed on an inside of the housing 30.

Out of the circulation pathway 18, the compressor 12, the heat exchanger 13, the flow adjustment valve 14, and the four-way valve 16 are provided on a portion located on the inside portion of the housing 30. Out of the circulation pathway 18, the compressor 12, the heat exchanger 13, the flow adjustment valve 14, and the four-way valve 16 are connected by a portion located on the inside portion of the housing 30.

Out of the circulation pathway 18, the four-way valve 16 is provided on a part that is connected to a discharge side of the compressor 12. By exchanging a portion of the circulation pathway 18, it is possible for the four-way valve 16 to reverse a direction of flow of the refrigerant 19 within the circulation pathway 18. When the path connected by the four-way valve 16 is the path of the four-way valve 16 that is shown by solid lines in FIG. 1, the refrigerant 19 within the circulation pathway 18 flows in the direction shown by the solid line arrow in FIG. 1. On the other hand, when the path connected by the four-way valve 16 is the path of the four-way valve 16 that is shown by dashed lines in FIG. 1, the refrigerant 19 flows within the circulation pathway 18 in the direction shown by the dashed line arrow in FIG. 1.

The indoor unit 20 includes a housing 21, a heat exchanger 22, and a blower 23. The housing 21 houses the heat exchanger 22, and the blower 23 on an inside thereof. It is possible for the indoor unit 20 to have a cooling operation where the air of the room the indoor unit 20 is disposed in is cooled, and to have a heating operation where the air of the room the indoor unit 20 is disposed in is heated.

When the indoor unit 20 is operated in the cooling operation, the refrigerant 19 that flows within the circulation pathway 18 flows in the direction shown by solid lines in FIG. 1. In other words, when the indoor unit 20 is operated in the cooling operation, the refrigerant 19 that flows within the circulation pathway 18 circulates so as to return to the compressor 12 after passing through the compressor 12, the heat exchanger 13 of the outdoor unit 10, the flow adjustment valve 14, and the heat exchanger 22 of the indoor unit 20 in such an order. During the cooling operation, the heat exchanger 13 of the outdoor unit 10 functions as a condenser, and the heat exchanger 22 of the indoor unit 20 functions as an evaporator.

On the other hand, when the indoor unit 20 is operated in the heating operation, the refrigerant 19 that flows within the circulation pathway 18 flows in the direction shown by dashed lines in FIG. 1. In other words, when the indoor unit 20 is operated in the heating operation, the refrigerant 19 that flows within the circulation pathway 18 circulates so as to return to the compressor 12 after passing through the compressor 12, the heat exchanger 22 of the indoor unit 20, the flow adjustment valve 14, and the heat exchanger 13 on an inside of the outdoor unit 10 in such an order. During the heating operation, the heat exchanger 13 of the outdoor unit 10 functions as the evaporator, and the heat exchanger 22 on an inside of the indoor unit 20 functions as the condenser.

Figure 2:
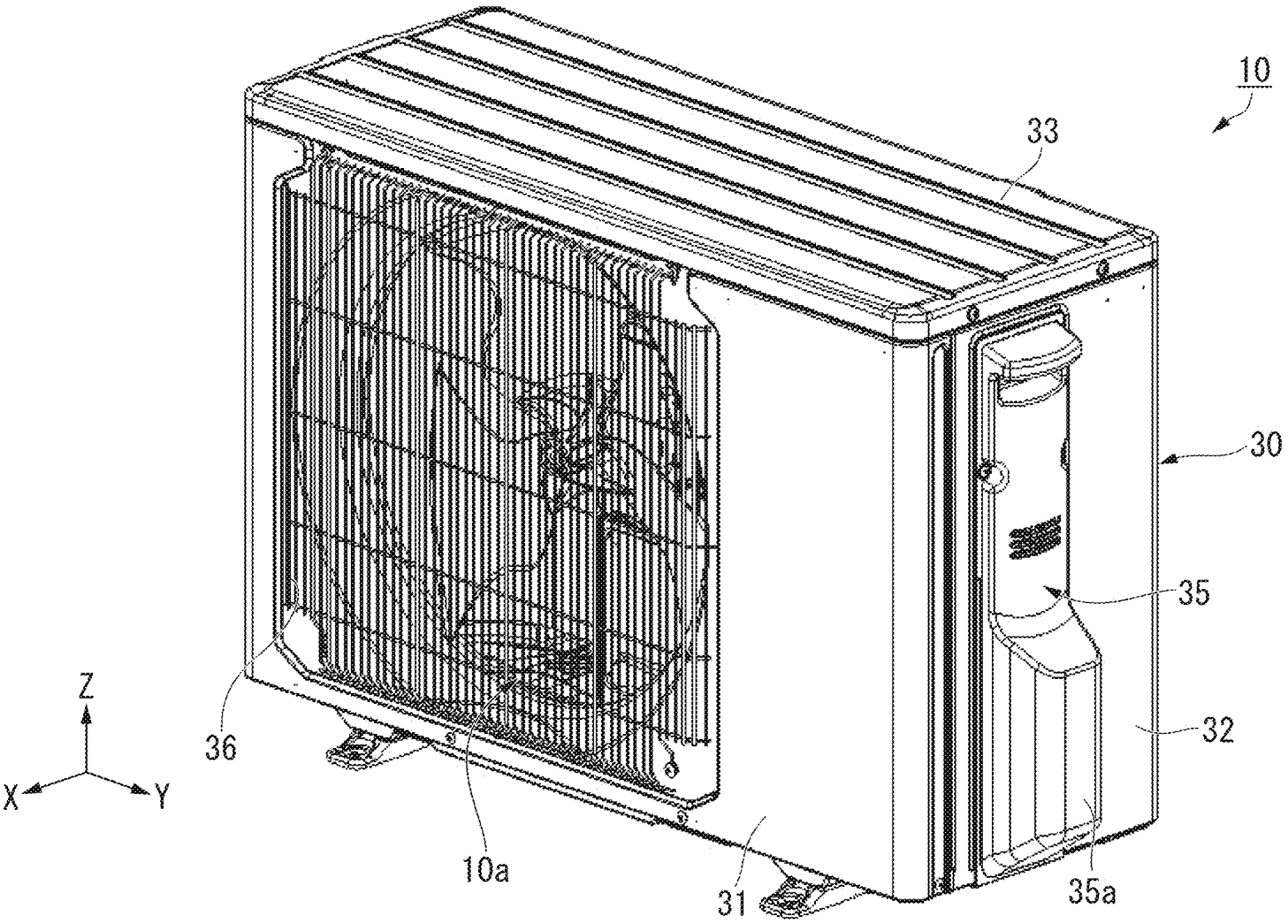
FIG. 2 A perspective view that shows an outdoor unit, in the first embodiment.
Figure 3:
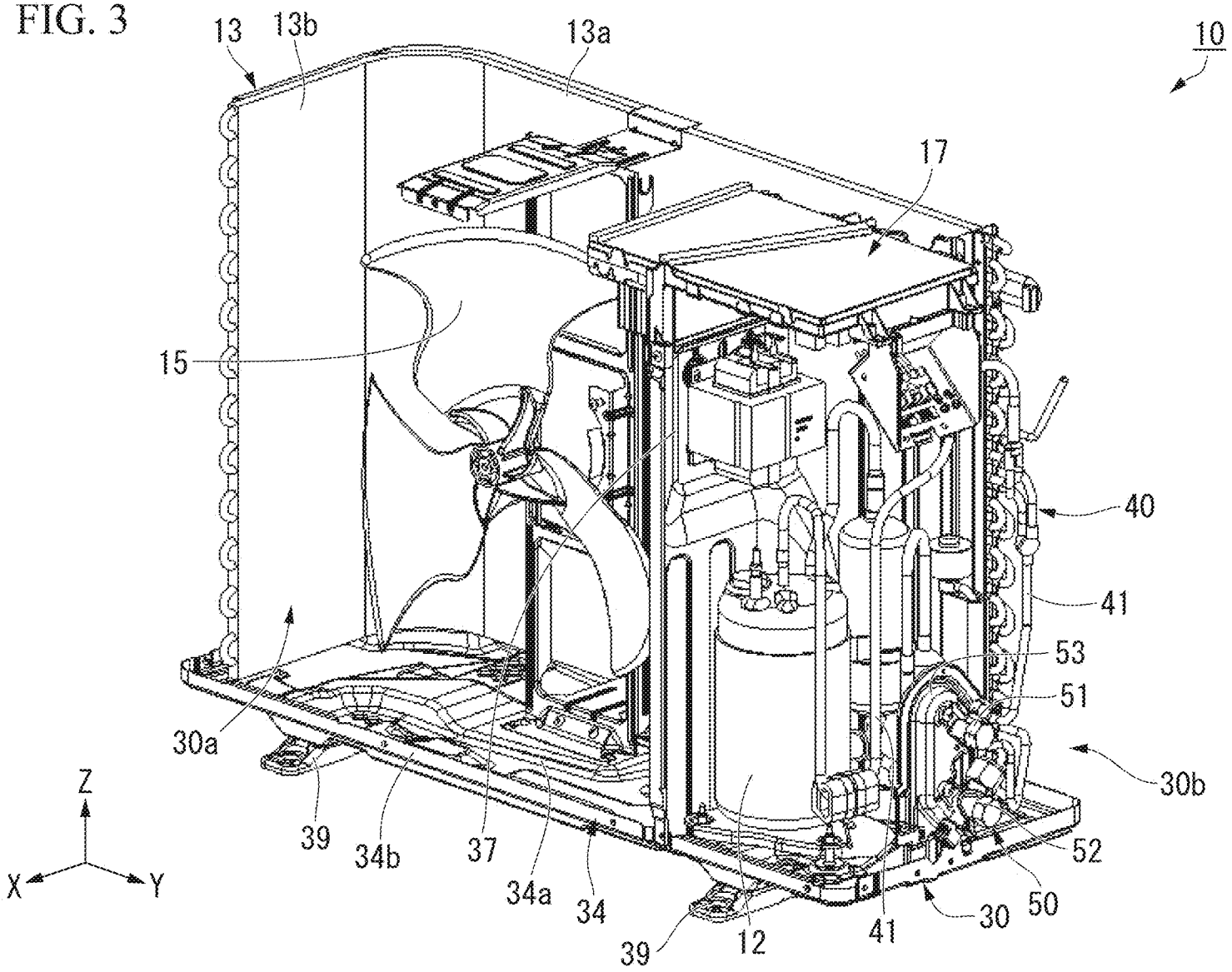
FIG. 3 A perspective view that shows a portion of the outdoor unit, in the first embodiment.
Figure 4:
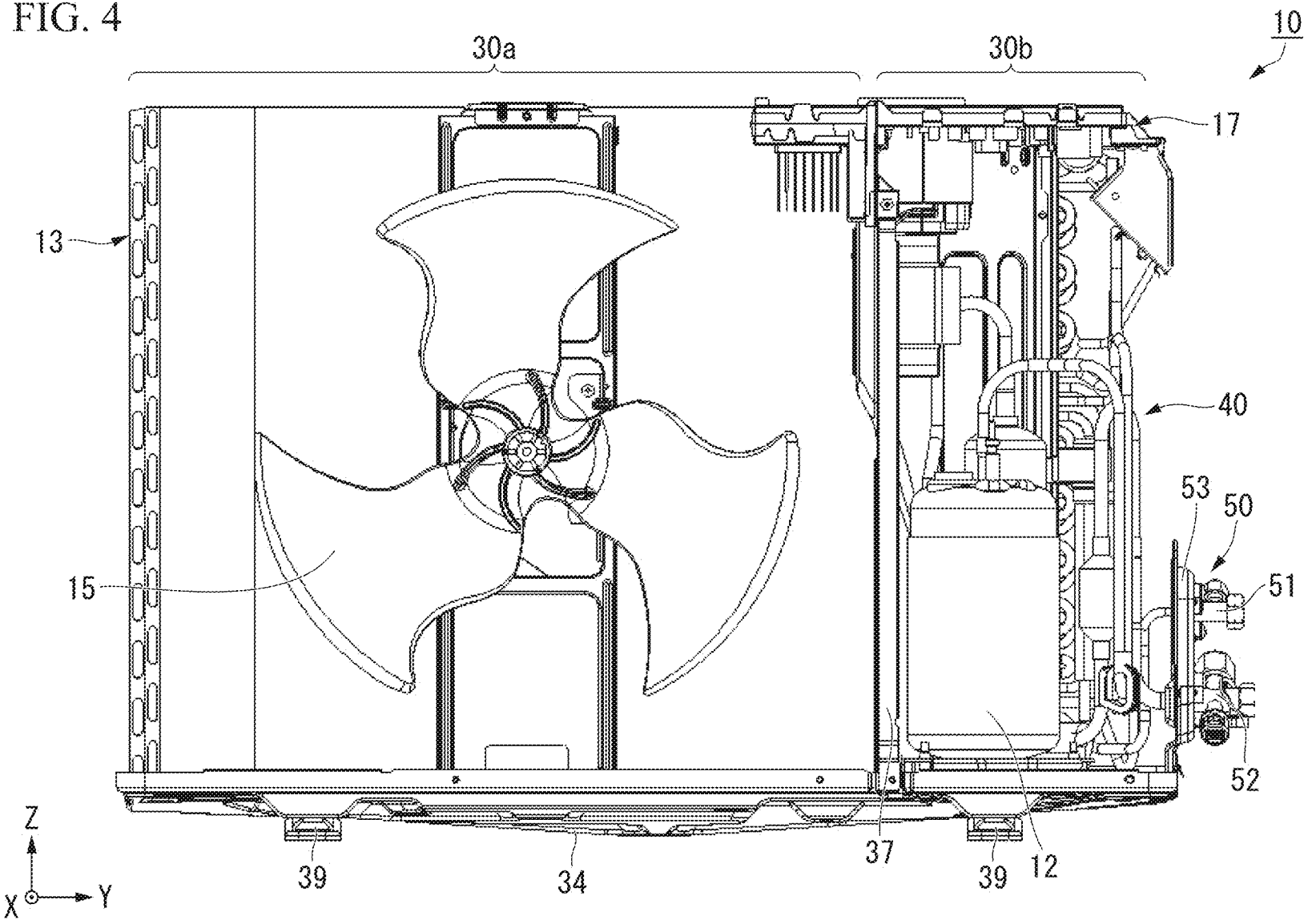
FIG. 4 A view that shows a portion of the outdoor unit, as seen from the front in the first embodiment.
Figure 5:
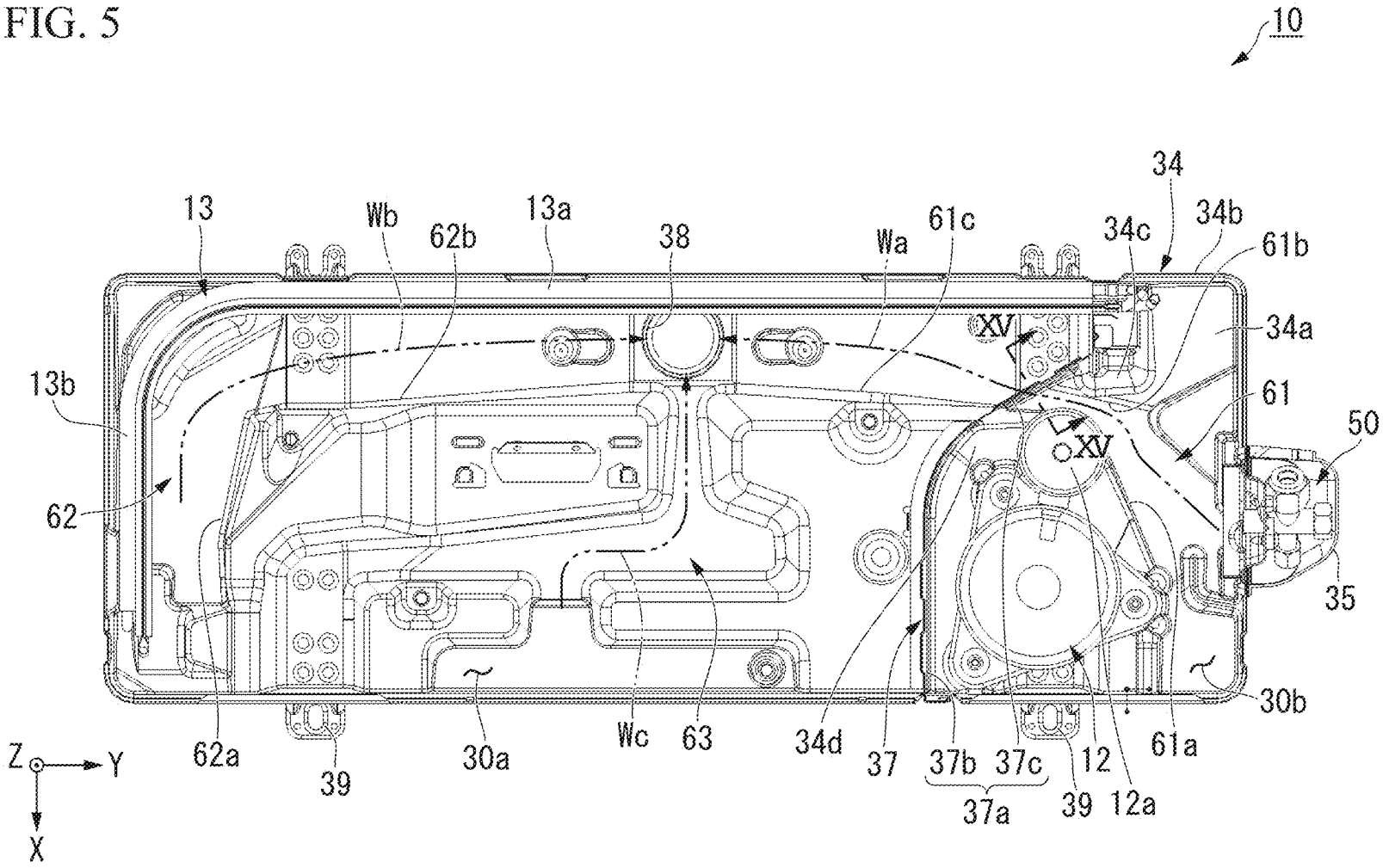
FIG. 5 A view that shows a portion of the outdoor unit, as seen from the top in the first embodiment.

Next, the outdoor unit 10 is explained in further detail. FIG. 2 is a perspective view that shows an outdoor unit 10. FIG. 3 is a perspective view that shows a portion of the outdoor unit 10. FIG. 4 is a view that shows a portion of the outdoor unit 10, as seen from the front. FIG. 5 is a view that shows a portion of the outdoor unit 10 as seen from the top.

As shown in FIG. 2, the housing 30 of the outdoor unit 10 is a long semi-square shaped box in the left-right direction Y. The housing 30 has a front surface panel 31 that configures a wall on the front side out of the housing 30, a right side panel 32 that configures a wall on the right side out of the housing 30, a ceiling surface panel 33 that configures a wall on the top side out of the housing 30. An exhaust **10*a* that is formed on the front side (+X side), in the front surface panel 31. The exhaust 10***a* is covered from the front side by a suitably looking grille 36 attached to the front surface panel 31.

As shown in FIG. 3 to FIG. 5, the housing 30 has a bottom plate 34 that configures a wall on the bottom side out of the housing 30, and a partitioning member 37 that partitions the inside of the housing 30 in the left-right direction Y. The bottom plate 34 is a bottom portion of the housing 30. A pair of legs 39 are provided on a bottom surface of the bottom plate 34. The pair of legs 39 are disposed in the left-right direction Y, with an interval therebetween. As shown in FIG. 3, the bottom plate 34 has a bottom plate main body 34*a*, and a frame 34*b*. The bottom plate main body 34*a* is a long semi-rectangular shape in the left-right direction Y, as seen from the vertical direction Z. The frame 34*b* protrudes to the top side, from an outside edge of the bottom plate main body 34*a*. The frame 34*b* is a long rectangular frame shape in the left-right direction Y.

The partitioning member 37 extends in the vertical direction Z. More specifically, the partitioning member 37 extends to the top side from the bottom plate main body 34*a*. As shown in FIG. 5, a part on the rear side (−X side) of the partitioning member 37 curves towards a mechanical room 30*b* side to be mentioned later on, in other words, to the left side, as seen in the vertical direction Z. The partitioning member 37, which partitions the inside of the housing 30, has a main body 37*a* that has a plate shape. A plate surface of the main body 37*a* faces a horizontal direction that is orthogonal with the vertical direction Z. The main body 37*a* has a first portion 37*b*, and a second portion 37*c*.

The first portion 37*b* extends in the front-rear direction X, as seen in the vertical direction Z. An end on the front side (+X side) of the first portion 37*b* is connected to the front surface panel 31. The second portion 37*c* is connected to an end on the rear side (−X side) of the first portion 37*b*. The second portion 37*c* extends so as to incline in the front-rear direction X and in the left-right direction Y. The second portion 37*c* extends to the rear side along with the right side, from an end on the rear side (−X side) of the first portion 37*b*, as seen in the vertical direction Z. A portion on the rear side (−X side) of the partitioning member 37 may curve to, or may not curve to a blower room 30*a* side, to be mentioned later on, as seen in the vertical direction Z.

The housing 30 has the blower room 30*a* and the mechanical room 30*b* that are partitioned from one another by the partitioning member 37. In the first embodiment, the blower room 30*a* corresponds to a "first room", and the mechanical room 30*b* corresponds to a "second room". The blower room 30*a* and the mechanical room 30*b* are disposed so as to be adjacent to one another in the left-right direction Y. A dimension of the blower room 30*a* in the left-right direction Y, is larger than a dimension of the mechanical room 30*b* in the left-right direction Y. The blower room 30*a* is located on the left side of the mechanical room 30*b*. As shown in FIG. 3, the heat exchanger 13 and the blower 15 are disposed on an inside of the blower room 30*a*.

The heat exchanger 13 in the first embodiment is a semi-L shape, as seen in the vertical direction Z. The heat exchanger 13 has a first portion 13*a* that extends in the left-right direction Y, as seen in the vertical direction Z, and a second portion 13*b* that extends from an end on the left side of the first portion 13*a* to the front side (+X side), as seen in the vertical direction Z. The first portion 13*a* is disposed on a rear end, on the inside of the blower room 30*a*. A right end of the first portion 13*a* is exposed to an inside of the mechanical room 30*b*. Refrigerant pipe cluster 40 that is disposed on the inside of the mechanical room 30*b* is connected to the right end of the first portion 13*a*. The second portion 13*b* is disposed on a left end, on the inside of the blower room 30*a*. The blower 15 is located on the front side of the first portion 13*a* in the heat exchanger 13, as well as the right side of the second portion 13*b* in the heat exchanger 13, on the inside of the blower room 30*a*. The heat exchanger 13 may be a straight shape, as seen in the vertical direction Z.

When the blower 15 operates, air is taken to the inside of the blower room 30*a* from an intake not shown on the drawings, that is provided on a wall on the rear side (−X side) of the blower room 30*a*. Air taken to the inside of the blower room 30*a* goes past the heat exchanger 13, and exits to an outside of the housing 30 from the exhaust 10*a* that is provided on a wall on the front side (+X side) of the blower room 30*a*. As such, the blower 15 sends air to the heat exchanger 13. In the first embodiment, since a portion on the rear side (−X side) of the partitioning member 37 curves towards the mechanical room 30*b* side, it is possible to make an air passage that the air which is sent by the blower 15 passes through, in an interval from the intake not shown in the drawings to an impeller of the blower 15, become narrower as the impeller of the blower 15 is approached. Accordingly, it is possible to increase air flow efficiency of the blower 15.

The compressor 12 and the controlling circuitry 17 are disposed on the inside of the mechanical room 30*b*. The compressor 12 is disposed on a bottom side portion out of the inside of the mechanical room 30*b*. The compressor 12 is a semi-cylindrical shape that extends in the vertical direction Z. In most cases, a temperature of the refrigerant 19 flowing into the compressor 12 is less than an ambient temperature of the inside of the mechanical room 30*b*. Accordingly, there are cases where condensation forms on a surface of the compressor 12. Condensation easily forms especially on an intake muffler 12*a* of the compressor 12 shown in FIG. 5, and on pipes connected to the intake muffler 12*a*. Said condensation is discharged to an outside of the outdoor unit 10 by a first drain water flow path portion 61, to be mentioned later on.

Figure 6:
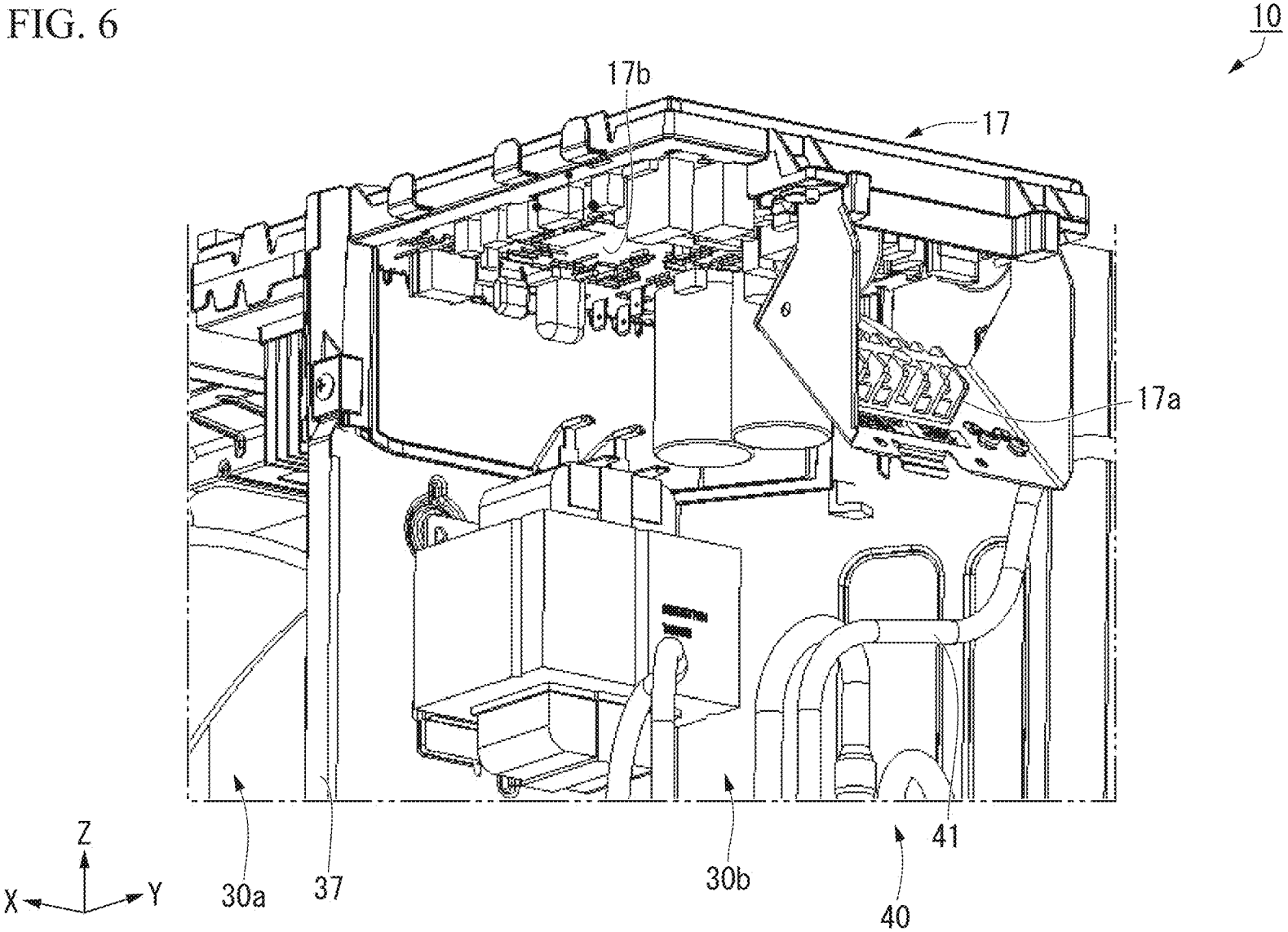
FIG. 6 A perspective view that shows controlling circuitry, in the first embodiment.

As shown in FIG. 3, the controlling circuitry 17 is disposed on a top side portion out of the inside of the mechanical room 30*b*. The controlling circuitry 17 is located on a top side of the compressor 12. The controlling circuitry 17 controls various parts of the outdoor unit 10. Specifically, the controlling circuitry 17 controls the compressor 12 and the blower 15. The controlling circuitry 17 for example, is a system controlling circuitry used to control the entirety of the refrigeration cycle device 100. FIG. 6 is a perspective view that shows controlling circuitry 17. The controlling circuitry 17 has a terminal block 17*a*, and a substrate 17*b*. Although omitted from the drawings, an electric power supply line that supplied electric power to the outdoor unit 10, and a connection line that connects the indoor unit 20 and the outdoor unit 10 are connected to the terminal block 17*a*. The substrate 17*b* is a substrate that controls the various parts of the outdoor unit 10. A plurality of electronic components that are exposed to the inside of the mechanical room 30*b*, are mounted on a bottom surface of the substrate 17*b*.

As shown in FIG. 3, the refrigerant pipe cluster 40 is disposed on the inside of the mechanical room 30*b*. The refrigerant pipe cluster 40 configures a portion of the circulation pathway 18. The refrigerant pipe cluster 40 has a plurality of refrigerant pipes 41. Although omitted from the drawings, the refrigerant pipe cluster 40 is connected to a pipe that extends from the indoor unit 20, via a valve unit 50.

Figure 7:
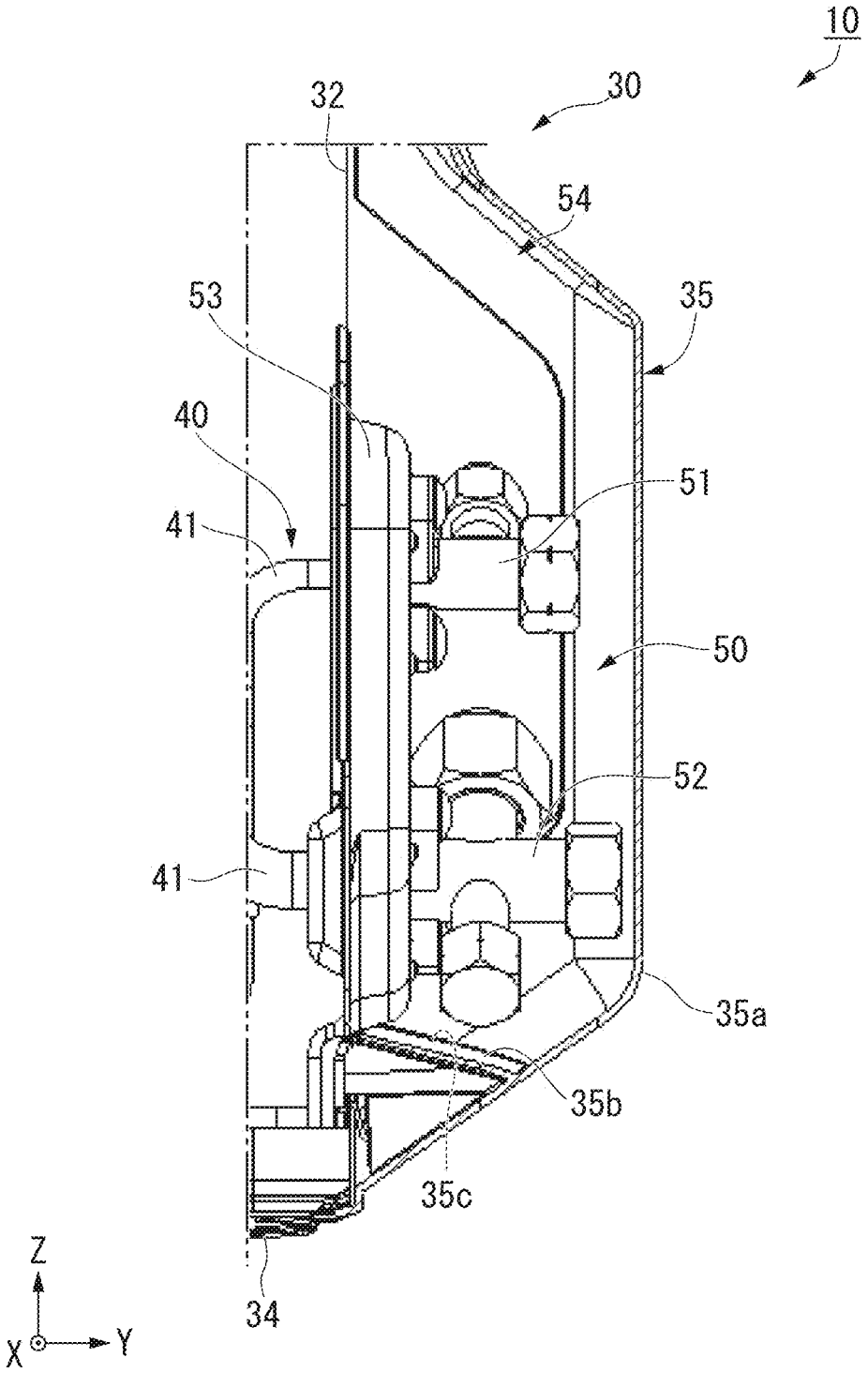
FIG. 7 A cross-sectional view that shows a valve unit and a protective cover, in the first embodiment.

The valve unit 50 is connected to a pipe that extends from the refrigerant pipe cluster 40 and the indoor unit 20. The valve unit 50 has a liquid valve 51, a gas valve 52, and a valve fixing portion 53. The valve fixing portion 53 extends to the top side, from an end on the right side of the bottom plate 34. A bottom end of the valve fixing portion 53 is fixed to the bottom plate 34. The bottom end of the valve fixing portion 53 is located on an inside of the frame 34*b*. FIG. 7 is a cross-sectional view that shows the valve unit 50 and a protective cover 35 to be mentioned later on. As shown in FIG. 7, the valve fixing portion 53, along with the right side panel 32, configures a portion of the right side wall of the housing 30.

The liquid valve 51 and the gas valve 52 configure a portion of the circulation pathway 18. The liquid valve 51 and the gas valve 52 are fixed to the valve fixing portion 53. The liquid valve 51 and the gas valve 52 protrude to the right side, from the valve fixing portion 53. The liquid valve 51 is located on the top side of the gas valve 52. Each of the liquid valve 51 and the gas valve 52 are connected to a refrigerant pipe 41 of the refrigerant pipe cluster 40. Out of a plurality of refrigerant pipes 41, a liquid pipe is connected to the liquid valve 51. Out of the plurality of refrigerant pipe 41, a gas pipe is connected to the gas valve 52. The liquid valve 51 and the gas valve 52 are located on an outside of the mechanical room 30*b*.

The liquid valve 51 and the gas valve 52 are covered from the right side using the protective cover 35. Using the protective cover 35, it is possible to suppress an unexpected impact to the liquid valve 51 and the to the gas valve 52. Accordingly, it is possible to suppress damage to the liquid valve 51 and the gas valve 52, and it is possible to suppress the refrigerant 19 from leaking from the liquid valve 51 and/or the gas valve 52.

Figure 8:
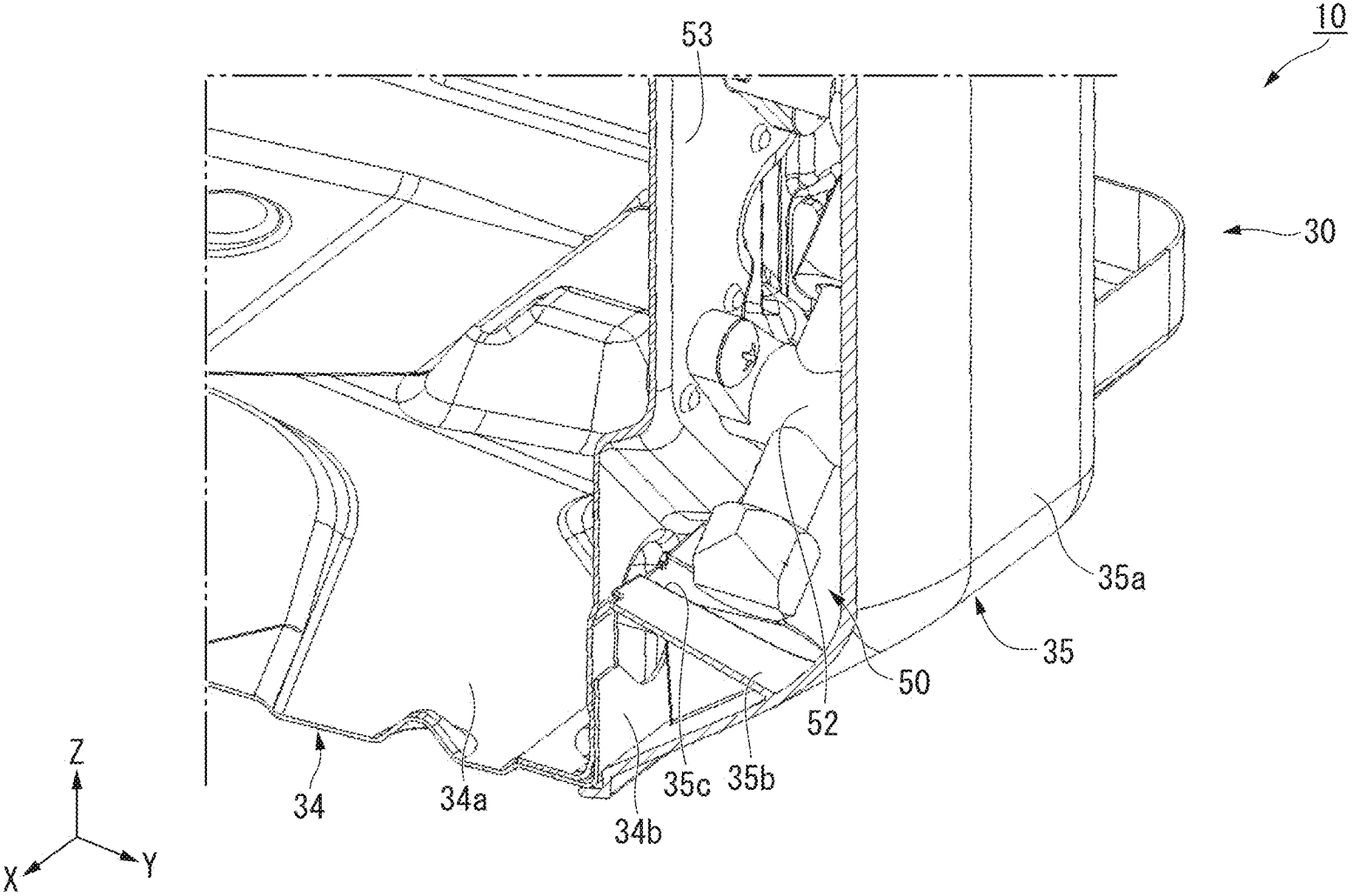
FIG. 8 A perspective cross-sectional view that shows the valve unit and the protective cover, in the first embodiment.

As shown in FIG. 2, the protective cover 35 is attached to a side surface on the right side of the housing 30. The protective cover 35 is attached to the right side panel 32. The protective cover 35 extends in the vertical direction Z. A bottom side portion of the protective cover 35 is a valve protector 35*a*. The valve protector 35*a* protrudes to the right side, more than a top side portion of the protective cover 35. FIG. 8 is a perspective cross-sectional view that shows the valve unit 50 and the protective cover 35. As shown in FIG. 7 and FIG. 8, the valve protector 35*a* is a box shape that opens to the left side. A valve accommodation 54 that houses the liquid valve 51 and the gas valve 52 is formed by a portion of the right side panel 32, the valve fixing portion 53, and the valve protector 35*a*.

Figure 9:
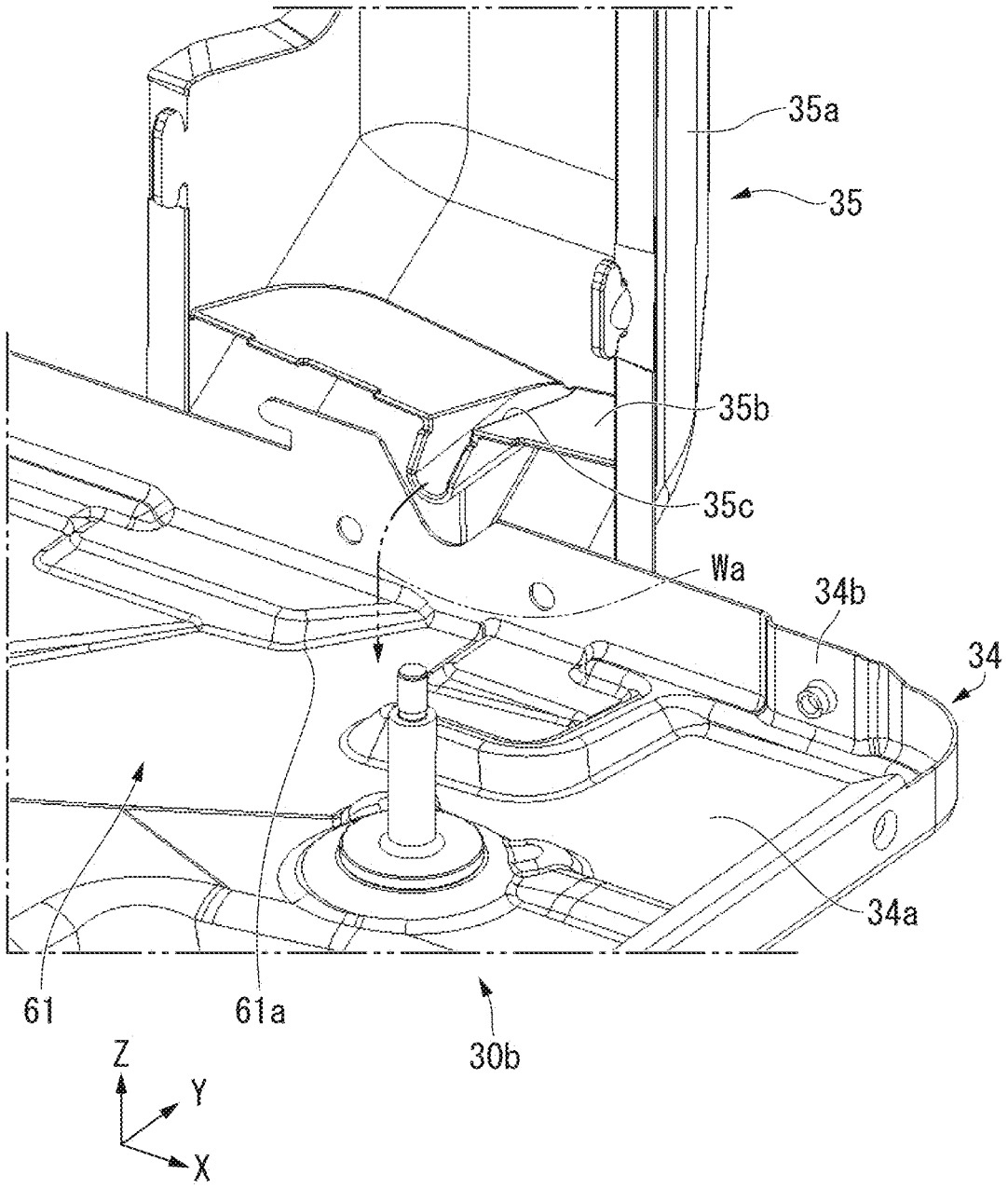
FIG. 9 A perspective view that shows a portion of the protective cover and a portion of a bottom plate, in the first embodiment.

FIG. 9 is a perspective view that shows a portion of the protective cover 35 and a portion of a bottom plate 34. As shown in FIG. 9, the protective cover 35 has a drain water guide 35*b* that protrudes to the left side (−Y side), from a surface on an inside of the valve protector 35*a*. A drain water groove 35*c* that recesses to the bottom side, is formed on a top surface of the drain water guide 35*b*. The drain water groove 35*c* extends in the left-right direction Y. The drain water groove 35*c* opens to the top side and to the left side. A groove bottom surface of the drain water groove 35*c* is an inclined surface that is located on the bottom side, as the left side is being approached. An end on the left side of the drain water groove 35*c* is located on a top side of a first flow path portion 61*a* of the first drain water flow path portion 61, to be mentioned later on. As shown in FIG. 7, the drain water guide 35*b* is located below the liquid valve 51 and the gas valve 52.

During cooling operation, the refrigerant 19 that is in a liquid state flows to the indoor unit 20 from the outdoor unit 10. As such, the liquid valve 51 is cooled by the refrigerant 19 that is in a liquid state, and a temperature of the liquid valve 51 is lower, compared to an outside temperature. In the cooling operation, the refrigerant 19 that is in a gaseous state flows from the indoor unit 20 to the outdoor unit 10, after exchanging heat with the air indoors at the heat exchanger 22 of the indoor unit 20. In most cases, the temperature of the refrigerant 19 that is in a gaseous state is low, compared to the outside temperature. As such, the gas valve 52 is cooled by the refrigerant 19 that is in a gaseous state, and it is easier for a temperature of the gas valve 52 to become low, compared to the outside temperature. Therefore, during cooling operation, it is easy for condensation to form on an outer surface of the liquid valve 51, and on an outer surface of the gas valve 52.

Condensation that forms on the outer surface of the liquid valve 51 and the outer surface of the gas valve 52, drips down to a top of the drain water guide 35*b*, flows through an inside of the drain water groove 35*c* as water Wa does along the dash-dotted line shown in FIG. 9, and is collected on the inside of the mechanical room 30*b*. More specifically, said condensation that flows to the inside of the drain water groove 35*c* is discharged from a left side opening of the drain water groove 35*c*, passes through a gap between the valve fixing portion 53 and the frame 34*b* of the bottom plate 34, and flows to an inside of the first drain water flow path portion 61 to be mentioned later on. Accordingly, leaking to the outside of the outdoor unit 10 and/or unexpected splashing on parts or the like, of condensation that forms on the outer surface of the liquid valve 51 and on the outer surface of the gas valve 52 is suppressed.

Since a hole through which a pipe that extends from the indoor unit 20 is formed on the protective cover 35, there are cases where water from rain or the like infiltrates to an inside of the valve accommodation 54 from said hole. In such a case, water from rain or the like flows to the first drain water flow path portion 61, passing through the drain water groove 35*c*. A number of pipes of the liquid valve 51 and a number of pipes of the gas valve 52 is not particularly limited. A positional relationship of the liquid valve 51 and the gas valve 52 is not particularly limited. It is possible for the protective cover 35 to cover the liquid valve 51 and the gas valve 52 from the bottom side only. In such a case, it is possible for condensation that drips down from the liquid valve 51 and the gas valve 52 to be guided to the first drain water flow path portion 61 to be mentioned later on, by the protective cover 35.

Figure 10:
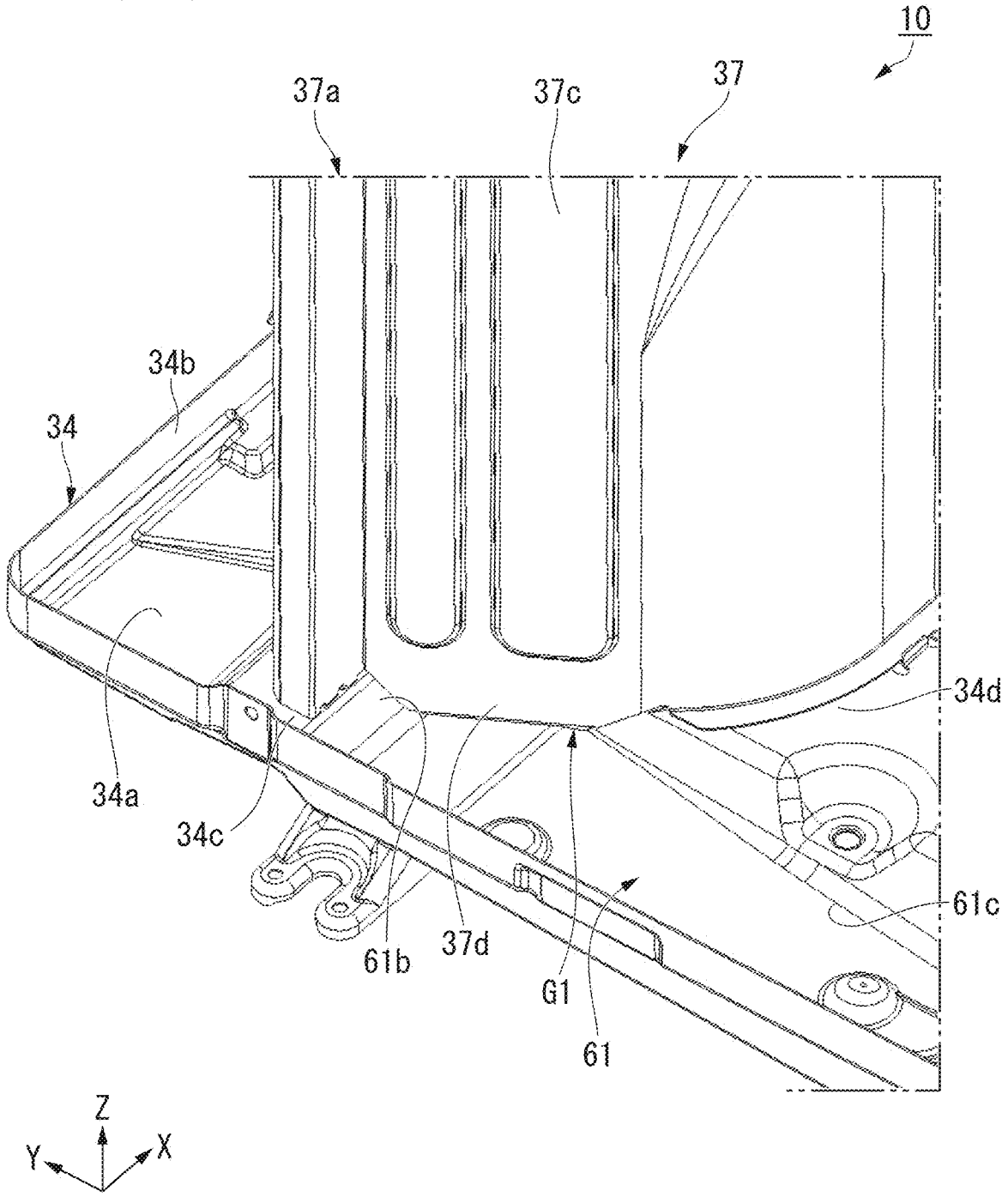
FIG. 10 A perspective view that shows a portion of the bottom plate and a portion of a partitioning member, in the first embodiment.
Figure 11:
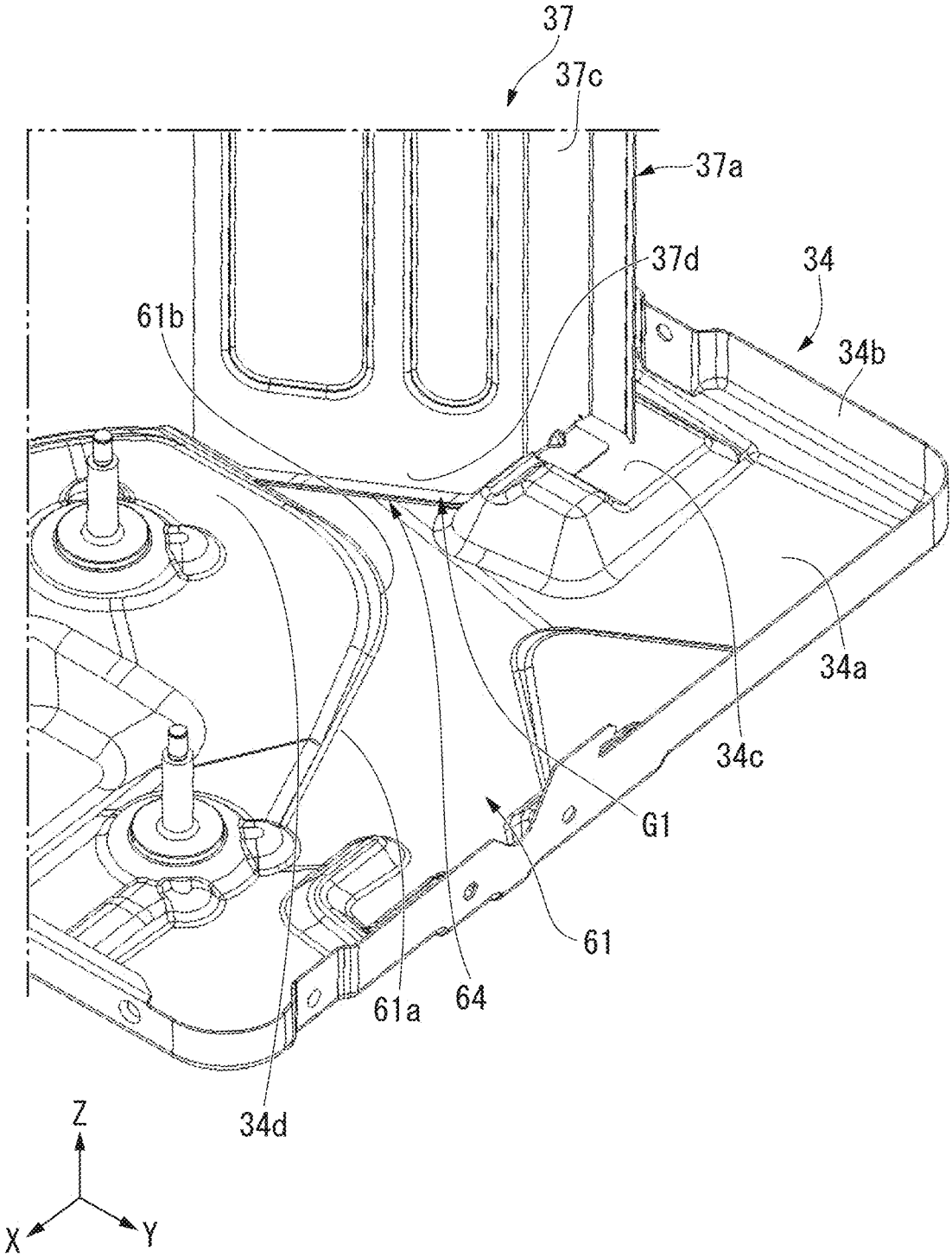
FIG. 11 A perspective view that shows a portion of the bottom plate and a portion of the partitioning member in the first embodiment, with each portion being viewed from a different angle than the angle of FIG. 10.
Figure 12:
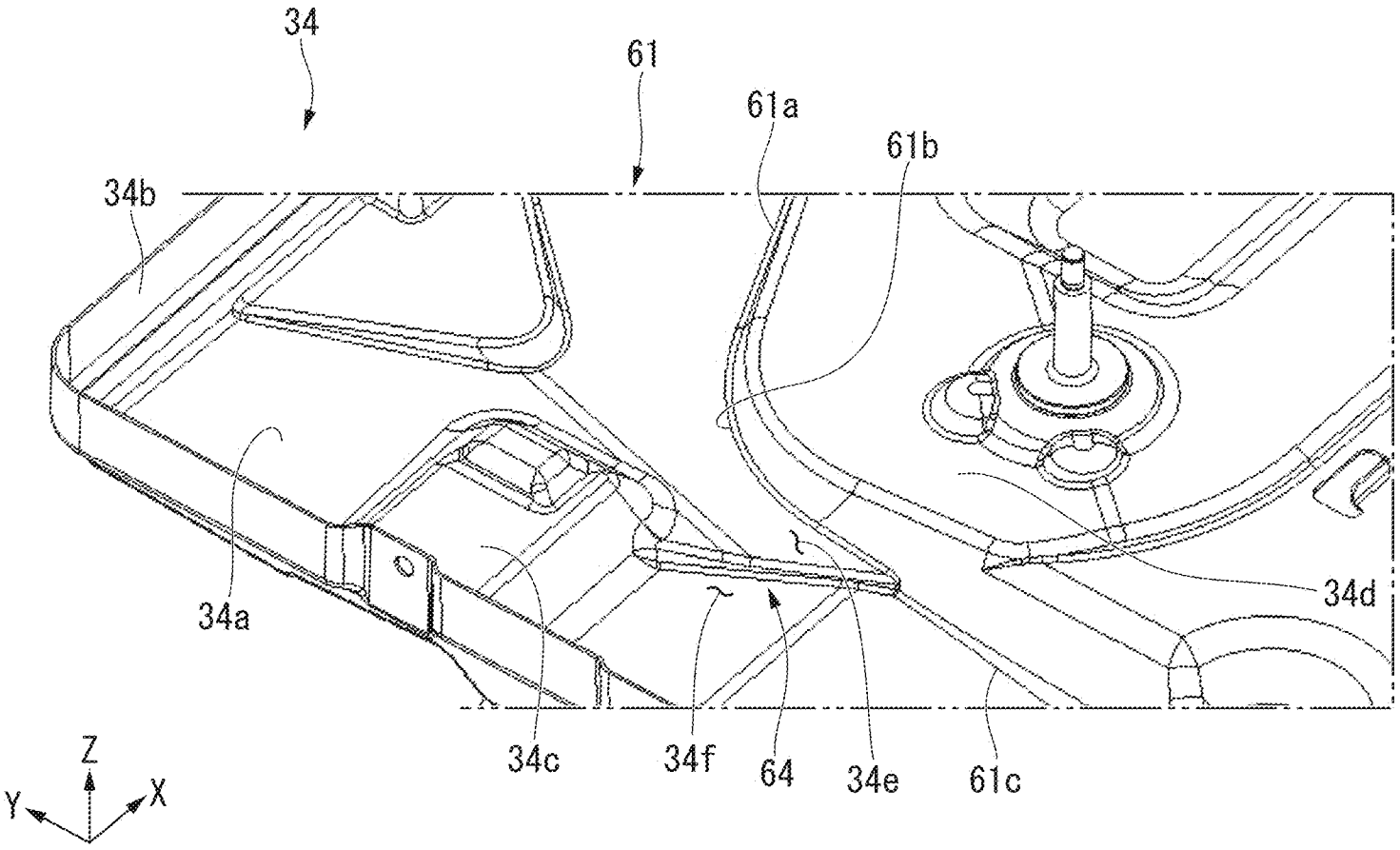
FIG. 12 A perspective view that shows a portion of the bottom plate, in the first embodiment.
Figure 13:
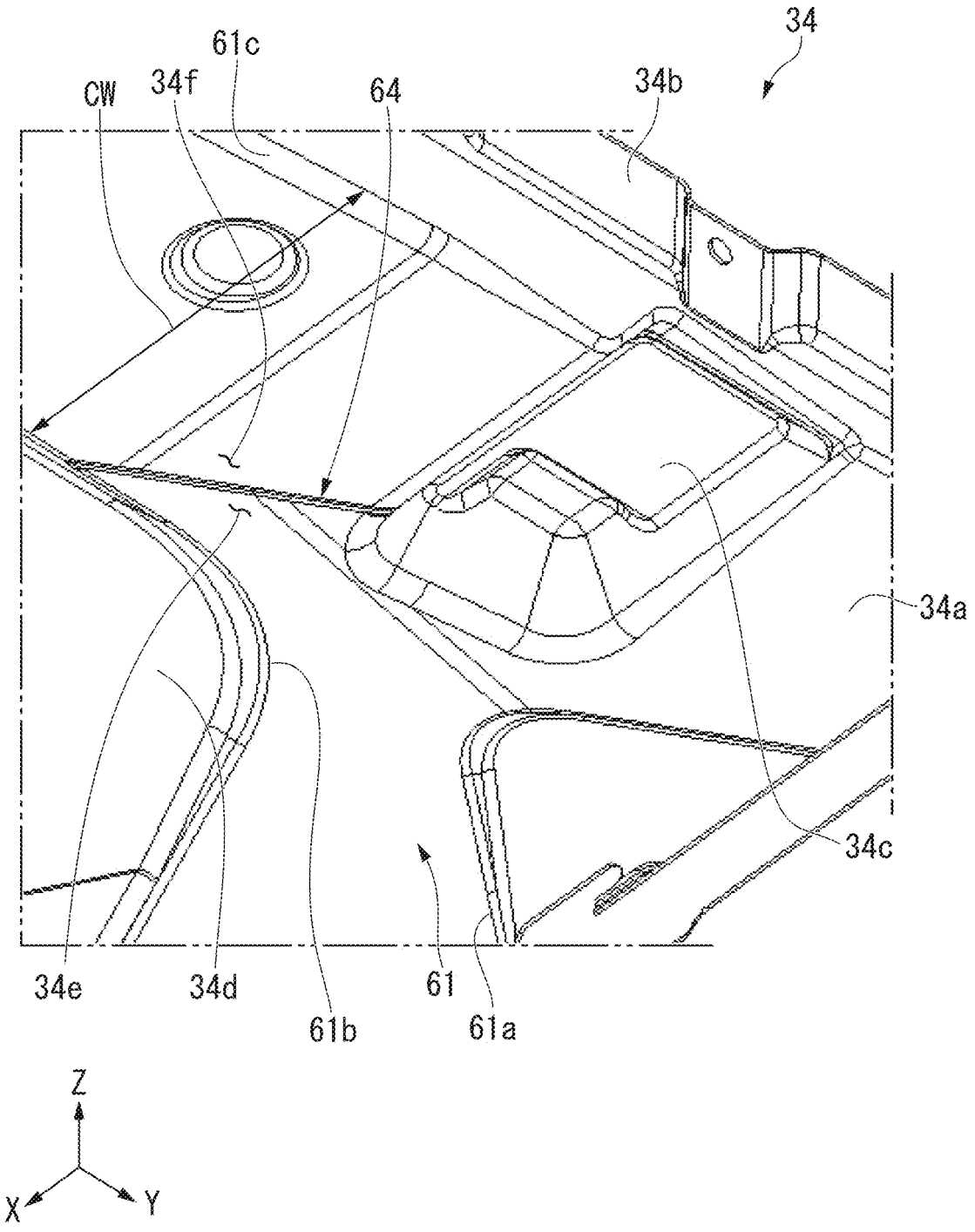
FIG. 13 A perspective view that shows a portion of the bottom plate in the first embodiment, viewed from a different angle than the angle of the portion of the bottom plate in FIG. 12.

Next, the bottom plate 34 and the partitioning member 37 are explained in further detail. FIG. 10 is a perspective view that shows a portion of the bottom plate 34 and a portion of the partitioning member 37. FIG. 11 is a perspective view that shows a portion of the bottom plate 34 and a portion of the partitioning member 37, with each portion being viewed from a different angle than the angle of FIG. 10. FIG. 12 is a perspective view that shows a portion of the bottom plate 34. FIG. 13 is a perspective view that shows a portion of the bottom plate 34, viewed from a different angle than the angle of the portion of the bottom plate 34 in FIG. 12.

As shown in FIG. 10 to FIG. 13, a pair of supports 34*c* and 34*d* are formed on the bottom plate 34. The pair of supports 34*c* and 34*d* are formed on a portion on the right side (+Y side) of the bottom plate 34. The pair of supports 34*c* and 34*d* protrude to the top side more than the first drain water flow path portion 61 to be mentioned later on. In the first embodiment, the pair of supports 34*c* and 34*d* are disposed so as to incline towards the left-right direction Y with respect to the front-rear direction X, with an interval therebetween.

The pair of supports 34*c* and 34*d* are each disposed in locations that support the second portion 37*c* of the partitioning member 37. The support 34*c* is located to the right side (+Y side) and to the rear side (−X side) more than the support 34*d*. The pair of supports 34*c* and 34*d* are disposed so as to sandwich a second flow path portion 61*b*, out of the first drain water flow path portion 61 to be mentioned later on.

As shown in FIG. 10 and in FIG. 11, the pair of supports 34*c* and 34*d* support the partitioning member 37 from the bottom side. More specifically, the pair of supports 34*c* and 34*d* support the second portion 37*c* out of the partitioning member 37 from the bottom side. The partitioning member 37 has a facing member 37*d* located between the pair of supports 34*c* and 34*d*. The facing member 37*d* protrudes to the bottom side from the second portion 37*c* of the partitioning member 37. The facing member 37*d* is a trapezoidal shape having a width that becomes narrower as the bottom side is approached, as seen from a direction that is orthogonal to a plate surface of the second portion 37*c*.

Various parts that are supported by the pair of supports 34*c* and 34*d* out of a bottom end of the partitioning member 37, and the pair of supports 34*c* and 34*d*, each support one another. A slight gap may be provided between the various parts that are supported by the pair of supports 34*c* and 34*d* out of the bottom end of the partitioning member 37, and the pair of supports 34*c* and 34*d*. In such case, said gap may be sealed off by a sealing material.

As shown in FIG. 5, a drain water hole 38 that penetrates the bottom plate 34 in the vertical direction Z, is formed on the bottom plate 34. The drain water hole 38 is formed on a portion that configures a bottom of the blower room 30*a* out of the bottom plate 34. The drain water hole 38 in the first embodiment is formed on a center part in the left-right direction Y, on an end of the rear side (−X side) of the bottom plate main body 34*a*. The drain water hole 38 is a circular shaped hole. An end on the rear side of the drain water hole 38 in the first embodiment is located below a bottom side of the first portion 13*a* of the heat exchanger 13.

Figure 14:
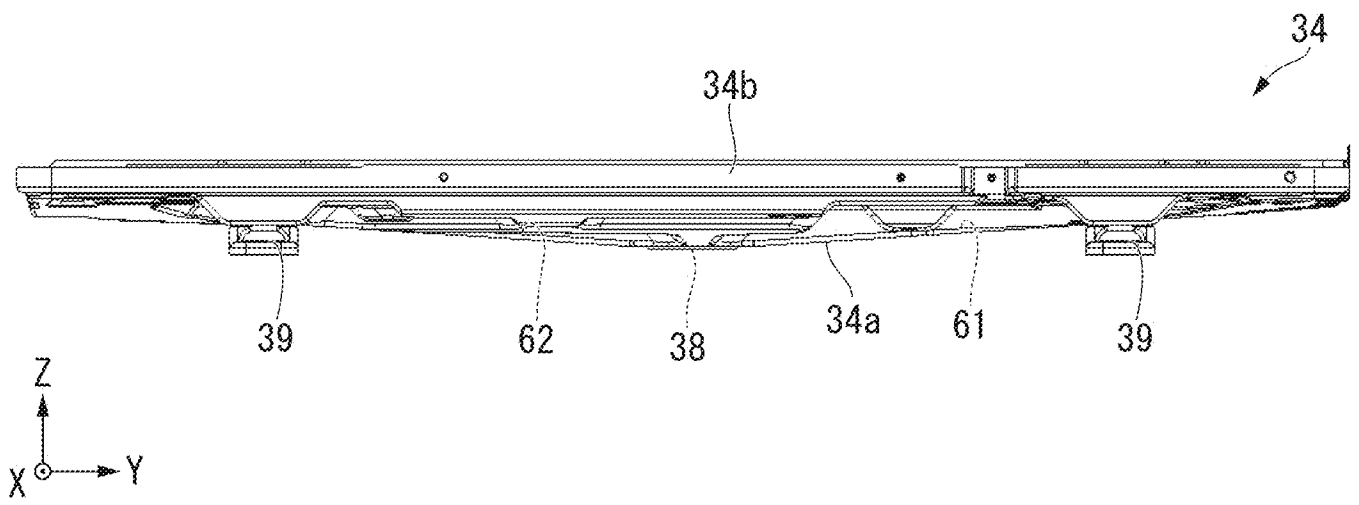
FIG. 14 A view that shows the bottom plate, as seen from a front side in the first embodiment.

FIG. 14 is a view that shows the bottom plate 34, as seen from a front side. As shown in FIG. 14, a portion of the bottom plate main body 34*a* recesses to the bottom side. The drain water hole 38 is formed on a portion that is located on the most bottom side in the bottom plate main body 34*a*. The drain water hole 38 is located more to the top side than a bottom surface of the pair of legs 39. The drain water hole 38 faces an installation surface where the outdoor unit 10 is installed, having a slight gap therebetween.

As shown in FIG. 5, the first drain water flow path portion 61, a second drain water flow path portion 62, and a third drain water flow path portion 63 are formed on the bottom plate 34. The first drain water flow path portion 61, the second drain water flow path portion 62, and the third drain water flow path portion 63 are formed by groves that recess to the bottom side, from a top surface of the bottom plate 34. Each drain water flow path portion in the first embodiment is made by protrusions and recesses that are formed by press working of the bottom plate 34. The first drain water flow path portion 61, the second drain water flow path portion 62, and the third drain water flow path portion 63 are connected to the drain water hole 38. The first drain water flow path portion 61 is located to the right side of the drain water hole 38. The second drain water flow path portion 62 is located on the left side of the drain water hole 38. The third drain water flow path portion 63 is located on the front side (+X side) of the drain water hole 38.

The first drain water flow path portion 61 is a drain water flow path portion that is formed so as to straddle the bottom of the blower room 30*a*, and a bottom of the mechanical room 30*b*. In other words, the first drain water flow path portion 61 is formed so as to straddle between the inside of the blower room 30*a* and the inside of the mechanical room 30*b*. The second drain water flow path portion 62 and the third drain water flow path portion 63 are drain water flow path portions that are formed on the bottom of the blower room 30*a*. In other words, the second drain water flow path portion 62 and the third drain water flow path portion 63 are formed on the inside of the blower room 30*a*.

The first drain water flow path portion 61 has the first flow path portion 61*a* that is formed on the inside of the mechanical room 30*b*, the second flow path portion 61*b* that is formed so as to straddle between the inside of the blower room 30*a* and the inside of the mechanical room 30*b*, and a third flow path portion 61*c* that is formed on the inside of the blower room 30*a*. The first flow path portion 61*a* extends to the rear side (−X side) and to the left side, from an end on the right side out of the bottom of the mechanical room 30*b*. As shown in FIG. 9, an end of the left side (−Y side) of the drain water groove 35*c* is located on the top side of an end on the right side (+Y side) in the first flow path portion 61*a*.

As shown in FIG. 5, the second flow path portion 61*b* slightly inclines to the rear side, and extends to the left side from a rear end of the first flow path portion 61*a*. The third flow path portion 61*c* extends to the left side from a left end of the second flow path portion 61*b*. The third flow path portion 61*c* is provided on an edge on the rear side, out of the bottom of the blower room 30*a*. A left end of the third flow path portion 61*c* is connected to the drain water hole 38.

As shown by the dash-dotted line in FIG. 5, water Wa due to condensation or the like that forms on an outer surface of the refrigerant pipe cluster 40 on an inside of the mechanical room 30*b*, the outer surface of the liquid valve 51, the outer surface of the gas valve 52, and the outer surface of the compressor 12, flows on the inside of the first drain water flow path portion 61. As shown in FIG. 14, a bottom surface of the first drain water flow path portion 61 is located to the bottom side, as the drain water hole 38 is approached. As such, water Wa that flows to the inside of the first drain water flow path portion 61, flows to the drain water hole 38 along the bottom surface of the first drain water flow path portion 61, due to a weight thereof. The water Wa on the inside of the valve accommodation 54, which is due to condensation or the like forming on the outer surface of the liquid valve 51 and/or the outer surface of the gas valve 52, flows to the inside of the first flow path portion 61*a* of the first drain water flow path portion 61 from the aforementioned drain water groove 35*c*, and flows in the order of the second flow path portion 61*b* and third flow path portion 61*c*, to the drain water hole 38.

In the explanations below, an upstream side of the flow of the water Wa, on the inside of the first drain water flow path portion 61, is simply referred to as an "upstream side". A downstream side of the flow of the water Wa, on the inside of the first drain water flow path portion 61, is simply referred to as a "downstream side". The water Wa that flows on the inside of the first drain water flow path portion 61 for example, includes water from rain or the like that flows to the inside of the valve accommodation 54 from the outside of the outdoor unit 10.

As shown in FIG. 12 and in FIG. 13, the second flow path portion 61*b* of the first drain water flow path portion 61 in the first embodiment is an inbetween flow path portion that is located between the pair of supports 34*c* and 34*d*. Side surfaces of a flow path width direction out of inner surfaces of the second flow path portion 61*b* are formed by side surfaces of each of the pair of supports 34*c* and 34*d*. The flow path width direction is a direction that is orthogonal to an extension direction in which the first drain water flow path portion 61 extends in, as seen from the top side and the vertical direction Z. A flow path width of the second flow path portion 61*b* is smaller than a flow path width at a portion that is connected to the second flow path portion 61*b* out of the first flow path portion 61*a*, and a flow path width at a portion that is connected to the second flow path portion 61*b* out of the third flow path portion 61*c*. In other words, the flow path width of the first drain water flow path portion 61 becomes smaller at the second flow path portion 61*b*. The flow path width of the second flow path portion 61*b* is smaller than a maximum flow path width of the third flow path portion 61*c* that is connected to the downstream side of the second flow path portion 61*b*, out of the first drain water flow path portion 61. The maximum flow path width of the third flow path portion 61*c* is for example, a flow path width CW shown on FIG. 13. The flow path width CW shown on FIG. 13 is a dimension of the front-rear direction X of a portion that is connected to the left side (−Y side) of a left end of a step portion 64 to be mentioned later on, out of the third flow path portion 61*c*. The flow path width of the first drain water flow path portion 61 is a dimension of the first drain water flow path portion 61 in the flow path width direction, which is orthogonal to both the extension direction in which the first drain water flow path portion 61 extends in as seen from the top side, and the flow path width direction that is orthogonal to the vertical direction Z.

As shown in FIG. 10 and in FIG. 11, the facing member 37*d* of the partitioning member 37 is inserted from the top side, in the second flow path portion 61*b* of the first drain water flow path portion 61. The facing member 37*d* in the first embodiment is fitted to an inside of the second flow path portion 61*b*. Each end of the facing member 37*d* on the flow path width direction of the second flow path portion 61*b* is in contact with an inside surface, located on both sides of the flow path width direction of the second flow path portion 61*b*. Said ends of the facing member 37*d* face one another via a gap G1 on the top side of a bottom surface of the second flow path portion 61*b*. The bottom surface of the second flow path portion 61*b* is a surface that is located on the bottom side, out of a surface on the inside of the second flow path portion 61*b*.

As shown in FIG. 12 and FIG. 13, the step portion 64 is formed on the bottom surface of the second flow path portion 61*b* out of the first drain water flow path portion 61 so as to have a side that is farther from the drain water hole 38 be higher than a side that is closer to the drain water hole 38, in the extension direction in which the second flow path portion 61*b* extends in, as seen from the top side. The step portion 64 is a step that protrudes to the top side as the inside of the second flow path portion 61*b* approaches the upstream side, from the downstream side. The step portion 64 in the first embodiment, extends in a direction that inclines towards the left-right direction Y, with respect to the front-rear direction X, as seen from the vertical direction Z. Each end out of both ends of the step portion 64 is connected to each of the pair of supports 34*c* and 34*d*.

A portion out of the bottom surface of the second flow path portion 61*b*, closer to the first flow path portion 61*a* more than the step portion 64, in other words a portion that is located on the upstream side more than the step portion 64 out of the bottom surface of the second flow path portion 61*b*, is an upstream bottom surface 34*e*. A portion out of the bottom surface of the second flow path portion 61*b*, closer to the third flow path portion 61*c* more than the step portion 64, in other words a portion that is located on the downstream side more than the step portion 64 out of the bottom surface of the second flow path portion 61*b*, is a downstream bottom surface 34*f*. The upstream bottom surface 34*e* is located more to the top side, than the downstream bottom surface 34*f*.

Figure 15:
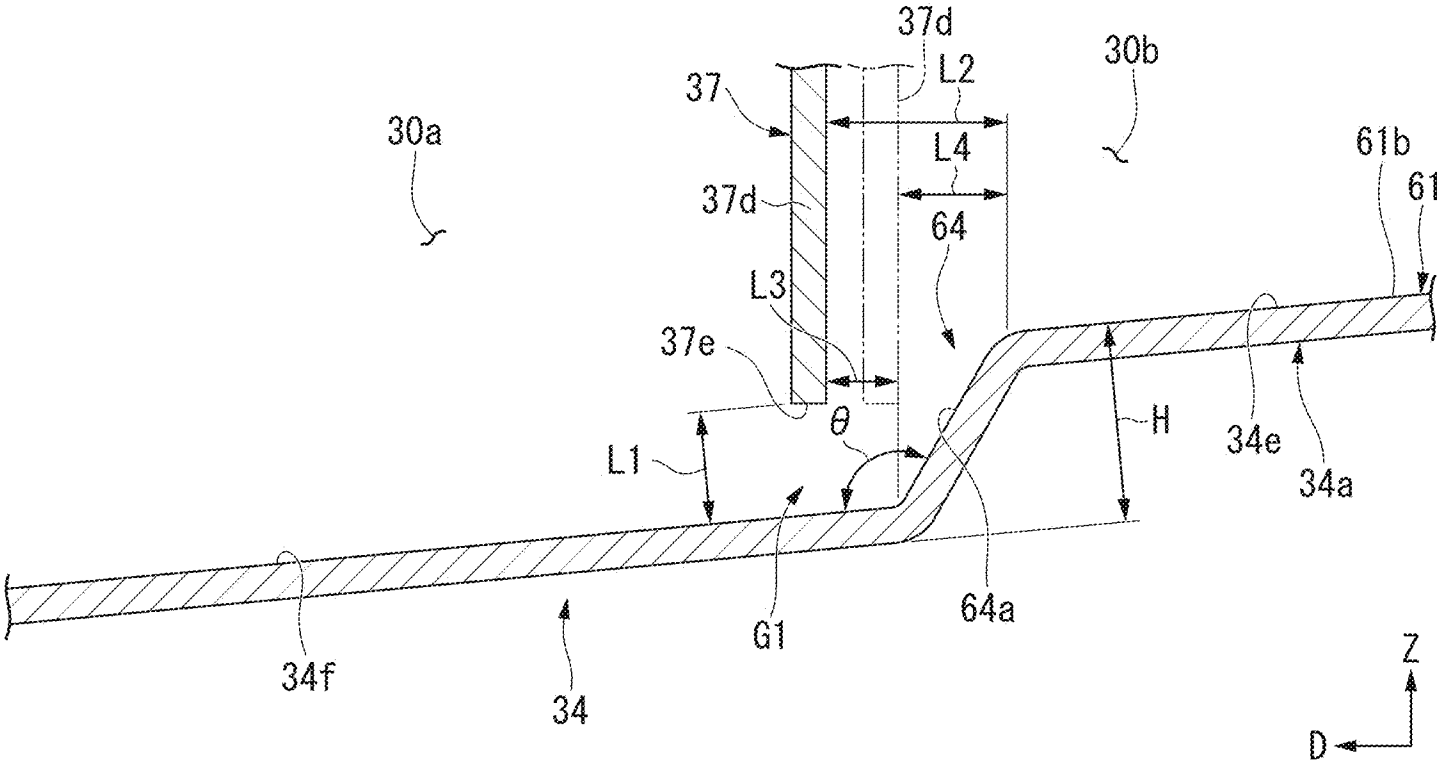
FIG. 15 A cross-sectional view that shows a portion of the bottom plate and a portion of the partitioning member in the first embodiment, taken from the cross-sectional line XV-XV of FIG. 5.

FIG. 15 is a cross-sectional view that shows a portion of the bottom plate 34 and a portion of the partitioning member 37, taken from the cross-sectional line XV-XV of FIG. 5. In FIG. 15, an extension direction D in which the second flow path portion 61*b* extends in, as seen from the top side, is shown by an arrow. The extension direction D is a direction in which the second flow path portion 61*b* extends in, as seen from the top side in the vertical direction Z, and is a direction that is orthogonal with the vertical direction Z. A side (+D side) that the arrow of the extension direction D points to is the downstream side. An opposing side (−D side), to the side that the arrow of the extension direction D points to is the upstream side.

As shown in FIG. 15, the upstream bottom surface 34*e* and the downstream bottom surface 34*f* are slightly inclined, with respect to a horizontal plane which is orthogonal to the vertical direction Z. The upstream bottom surface 34*e* and the downstream bottom surface 34*f* are located to the bottom side, as the drain water hole 38 is approached. The upstream bottom surface 34*e* and the downstream bottom surface 34*f* are connected via a step surface 64*a* of the step portion 64. The upstream bottom surface 34*e* is located to the bottom side, as the upstream bottom surface 34*e* gets closer to the step surface 64*a*. The downstream bottom surface 34*f* is located to the bottom side, as the downstream bottom surface 34*f* separates from the step surface 64*a*.

The step surface 64*a* of the step portion 64 is a surface that faces the downstream side, as well as the top side. A top end of the step surface 64*a* is connected to an end on the downstream side of the upstream bottom surface 34*e*. The top end of the step surface 64*a* is a top end of the step portion 64. A bottom end of the step surface 64*a* is connected to an end on the upstream side of the downstream bottom surface 34*f*. The bottom end of the step surface 64*a* is a bottom end of the step portion 64. The step surface 64*a* is located on the downstream side (+D side) of the extension direction D, as the bottom side is approached. In the first embodiment, an angle θ that is formed by the step surface 64*a* and the downstream bottom surface 34*f*, is an obtuse angle. Accordingly, when the bottom plate 34 is made using sheet metal or the like, making the step portion 64 is easy. The angle θ may be a 90 degree angle, or may be an acute angle. By making the angle θ be a 90 degree angle, or an acute angle, an effect of suitably suppressing small creatures C from entering to the inside of the mechanical room 30*b* is obtainable, as is mentioned later on.

The step portion 64 is located on the upstream side (−D side), more than the facing member 37*d* of the partitioning member 37. Accordingly, an end 37*e* on the bottom side of the facing member 37*d* is disposed on the top side of the downstream bottom surface 34*f*, with the gap G1 therebetween. The step portion 64 in the first embodiment is formed on a portion located on the inside of the mechanical room 30*b*, out of the bottom surface of the second flow path portion 61*b*. The phrase "the step portion 64 in the first embodiment is formed on a portion located on the inside of the mechanical room 30*b*, out of the bottom surface of the second flow path portion 61*b*" is not limited to a main body of the step portion 64 be formed on a portion that is located on the inside of the mechanical room 30*b*, out of the bottom surface of the second flow path portion 61*b*, and includes other portions of the step portion 64 being formed on a portion located on the inside of the mechanical room 30*b*, out of the bottom surface of the second flow path portion 61*b*, with a part of the step portion 64 being located on the bottom side of the facing member 37*d*. In the first embodiment, an entirety of the step portion 64, in other words, an entirety of the step surface 64*a* is formed on a portion that is located on the inside of the mechanical room 30*b*, out of the bottom surface of the second flow path portion 61*b*. An end on the top side of the step portion 64 is located to the top side, more than end 37*e* on the bottom side of the facing member 37*d*. The end on the top side of the step portion 64 is disposed on the upstream side of the facing member 37*d*, with an interval therebetween.

A distance L2 in the extension direction D between the end on the top side of the step portion 64 and the facing member 37*d*, is larger than a shortest distance L1 between the facing member 37*d* and the bottom surface of the second flow path portion 61*b*. The shortest distance L1 is the shortest distance between the downstream bottom surface 34*f* and the end 37*e* on the bottom side of the facing member 37*d*. The shortest distance L1 is a dimension of the gap G1 in a direction orthogonal to the downstream bottom surface 34*f*. A distance L3 in the extension direction D between an end on the bottom side of the step portion 64 and the facing member 37*d*, is smaller than the shortest distance L1 between the facing member 37*d* and the bottom surface of the second flow path portion 61*b*. The shortest distance L1, the distance L2, and the distance L3 are for example, greater than or equal to 1 mm, and less than or equal to 30 mm.

A height H of the step portion 64 in the first embodiment is greater than or equal to half of the shortest distance L1 between the facing member 37*d* and the bottom surface of the second flow path portion 61*b*. The height H of the step portion 64 is a dimension of the step portion 64 in a direction orthogonal to the downstream bottom surface 34*f*. The height H of the step portion 64 is the distance between the upstream bottom surface 34*e* and the downstream bottom surface 34*f* in a direction orthogonal to the downstream bottom surface 34*f*. Specifically, in the first embodiment, the height H of the step portion 64 is larger than the shortest distance L1 between the partitioning member 37 and the bottom surface of the second flow path portion 61*b*.

As shown in FIG. 5, the second drain water flow path portion 62 has a first flow path portion 62*a*, and a second flow path portion 62*b*. The first flow path portion 62*a* is formed on an edge on the left side out of the bottom of the blower room 30*a*. The first flow path portion 62*a* extends in the front-rear direction X. The second flow path portion 62*b* extends to the right side, from a rear end of the first flow path portion 62*a*. The second flow path portion 62*b* is formed on an edge on the rear side (−X side), out of the bottom of the blower room 30*a*. A right end of the second flow path portion 62*b* is connected to the drain water hole 38. Water Wb that results from condensation or the like on the outer surface of the heat exchanger 13 flows to an inside of the second drain water flow path portion 62. A shown in FIG. 14, the bottom surface of the second drain water flow path portion 62 is located to the bottom side as the bottom surface of the second drain water flow path portion 62 approaches the drain water hole 38. As such, the water Wb that flows to the inside of the second drain water flow path portion 62, flows to the drain water hole 38 along the bottom surface of the second drain water flow path portion 62. The water Wb that flows to the inside of the second drain water flow path portion 62 for example, includes water from rain or the like that flows to the inside of the blower room 30*a*, from the outside of the outdoor unit 10.

As shown in FIG. 5, the third drain water flow path portion 63 is formed on a center part in the left-right direction Y, out of the bottom of the blower room 30*a*. A rear and of the third drain water flow path portion 63 is connected to the drain water hole 38. Water Wc from rain or the like flows to the inside of the housing 30 from the exhaust 10*a*, on the inside of the third drain water flow path portion 63. Although omitted from the drawings, a bottom surface of the third drain water flow path portion 63 is located to the bottom side, as the drain water hole 38 is approached. As such, the water Wc that flows to the inside of the third drain water flow path portion 63, flows to the drain water hole 38 along the bottom surface of the third drain water flow path portion 63. The water Wc that flows to the inside of the third drain water flow path portion 63 for example, includes water from rain or the like that flows to the inside of the blower room 30*a*, from places other than the exhaust 10*a*.

According to the first embodiment, the first drain water flow path portion 61 has the second flow path portion 61*b* as the inbetween flow path portion, located between the pair of the supports 34*c* and 34*d*. The partitioning member 37 has the facing member 37*d* that opposes the bottom surface of the second flow path portion 61*b* on a top side in the vertical direction, via the gap G1. The step portion 64 is formed so as have a side (−D side) that is farther from the drain water hole 38 be higher than a side (+D side) that is closer to the drain water hole 38, on the bottom surface of the second flow path portion 61*b* in the extension direction D in which the second flow path portion 61*b* extends in, as seen from the top side in the vertical direction. As such, the facing member 37*d* and the step portion 64 are provided in locations that are close to one another, and it is possible to suitably create a structure where it is difficult for small creatures to enter to the inside of the mechanical room 30*b* from the inside of the blower room 30*a* using the facing member 37*d* and the step portion 64. Accordingly, it is possible to suppress small creatures from entering to the inside of the mechanical room 30*b*. Therefore, it is possible to suppress having small creatures come into contact with the controlling circuitry 17. As such, it is possible to suppress small creatures from coming into contact with the terminal block 17*a* and the substrate 17*b* or the like, and it is possible to suppress malfunctions from occurring in the controlling circuitry 17.

On the other hand, since it is possible for the water Wa to flow in the gap G1 between the facing member 37*d* and the bottom surface of the second flow path portion 61*b*, it is possible to have the water Wa that flows on the inside of the second flow path portion 61*b*, flow to the drain water hole 38. Accordingly, it is possible to discharge the water Wa of the inside of the mechanical room 30*b* to the outside of the housing 30, via the drain water hole 38. Therefore, it is possible to suppress having the water Wa from continually accumulating on the inside of the housing 30. In the first embodiment, as mentioned above, since it is possible to form the facing member 37*d* and the step portion 64 into a structure where it is difficult for small creatures to enter to the inside of the mechanical room 30*b* from the inside of the blower room 30*a*, it is possible to appropriately open the gap G1 so as discharge the water Wa to the outside of the housing 30, while suppressing small creatures from entering to the inside of the mechanical room 30*b*.

Figure 16:
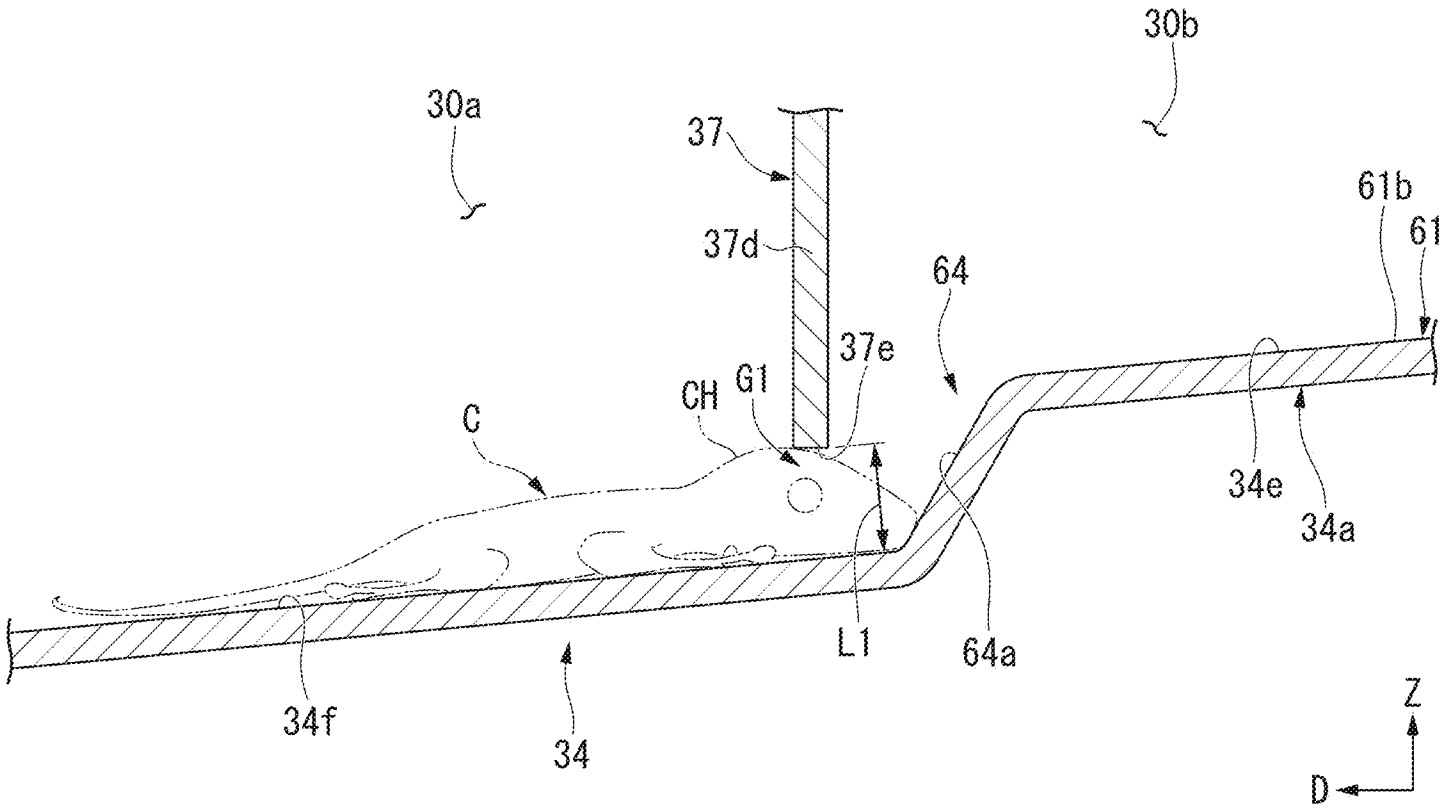
FIG. 16 A view that explains effects of the first embodiment.

Specifically, according to the first embodiment, the step portion 64 is formed on a portion located on the inside of the mechanical room 30*b* out of the bottom surface of the second flow path portion 61*b*. Therefore, as shown in FIG. 16, it is possible to prevent the small creatures C from entering to the inside of the mechanical room 30*b*. FIG. 16 is a view that explains effects of the first embodiment. The small creature C shown in FIG. 16 is for example, a gecko. As shown in FIG. 16, when a creature C that has entered to the inside of the blower room 30*a* tries to pass through the gap G1 so as to enter to the inside of the mechanical room 30*b*, the creature comes into contact with the step portion 64 provided in the vicinity of the facing member 37*d*, before completely going past the gap G1. In the example of the FIG. 16, a case where half of a head CH of the creature C passes through the gap G1, and a tip of the head CH contacts the step surface 64*a* of the step portion 64 is shown. Although the creature C that is in contact with the step portion 64 tries to move to the top side, since the facing member 37*d* is on the top side, it is not possible for the creature C to move to the top side. Accordingly, moving of the creature C through the gap G1 to the mechanical room 30*b* is suppressed. Therefore, it is possible to suitably prevent the small creature C from entering to the inside of the mechanical room 30*b*.

According to the first embodiment, the height H of the step portion 64 greater than or equal to half of the shortest distance L1 between the facing member 37*d* and the bottom surface of the second flow path portion 61*b*. As such, after the creature C comes into contact with the step portion 64, it is possible to suppress the creature C from going over the step portion 64 and entering to the inside of the mechanical room 30*b*. Therefore, it is possible to suppress having the small creature C from entering to the inside of the mechanical room 30*b*.

Specifically, for example, when the head CH of the creature C is considered as a long semi-elliptical shape in the horizontal direction, a short diameter of the head CH is approximately the same as the shortest distance L1, and a distance from the gap G1 to the step portion 64 in the extension direction D is the same order of magnitude as a long diameter of the head CH, the tip of the head CH reaches the step portion 64 in a state of being in contact with an end on the bottom side of the partitioning member 37 and the bottom surface of the second flow path portion 61*b*. At such time, if the height H of the step portion 64 is smaller than half of the shortest distance L1, it is easy for the tip of the head CH to move to the top side, without the tip of the head CH coming into contact with the step portion 64. As such, there is a risk of the small creature C going over the step portion 64 and easily entering to the inside of the mechanical room 30*b*. In contrast to the above, by having the height H of the step portion 64 be greater than or equal to half the shortest distance L1, the tip of the head CH comes into contact with the step portion 64, and the head CH is in a state of having a three point contact with the end 37*e* on the bottom side of the facing member 37*d*, the bottom surface of the second flow path portion 61*b*, and the step portion 64. As such, it is possible to have it so that it is difficult to rotate the tip of the head CH, considered to be an elliptical shape, in the direction of movement, and it is possible to make it difficult for the creature C to overcome the step portion 64. Accordingly, it is possible to suppress having the small creature C from entering to the inside of the mechanical room 30*b*.

Particularly, in the first embodiment, the height H of the step portion 64 is larger than the shortest distance L1 between the facing member 37*d* and the bottom surface of the second flow path portion 61*b*. As such, after having come into contact with the step portion 64, it is possible to suitably suppress the creature C from going over the step portion 64 and entering to the inside of the mechanical room 30*b*. Therefore, it is possible to further suitably suppress the small creature C from entering to the inside of the mechanical room 30*b*.

According to the first embodiment, the distance L3 in the extension direction D between an end on the bottom side in the vertical direction of the step portion 64, and the facing member 37*d*, is smaller than the shortest distance L1 between the facing member 37*d* and the bottom surface of the second flow path portion 61*b*. As such, for most cases where the head CH of the creature C is longer in the horizontal direction, it is easy to have the head CH contact the step portion 64 before going past the gap G1. Accordingly, it is possible to further suitably suppress the head CH from going past the gap G1. Therefore, it is possible to further suitably suppress the small creature C from entering to the inside of the mechanical room 30*b*.

According to the first embodiment, the flow path width of the second flow path portion 61*b* is smaller than the maximum flow path width of the third flow path portion 61*c* that is connected to the downstream side of the second flow path portion 61*b*, out of the first drain water flow path portion 61. As such, it is easier to have a dimension of the flow path direction between the facing member 37*d* and the bottom surface of the second flow path portion 61*b*, be smaller, compared to the flow path width of the third flow path portion 61*c* of the inside of the blower room 30*a*. Accordingly, it is possible to further suppress the small creature C that enters the third flow path portion 61*c* from going past the gap G1, and entering to the inside of the mechanical room 30*b*.

According to the first embodiment, the bottom surface of the first drain water flow path portion 61 is located to the bottom side in the vertical direction, as the drain water hole 38 is approached. As such, it is easier to have the water Wa from condensation or the like, flow along the bottom surface of the first drain water flow path portion 61 to the drain water hole 38. Accordingly, it is possible to suitably discharge the water Wa to the outside of the outdoor unit 10 via the drain water hole 38.

In the first embodiment, a location of the facing member 37*d* with respect to the step portion 64 may be the location shown by the dash-dotted line shown in FIG. 15. In such case, a distance L4 in the extension direction D between an end on the top side in the vertical direction of the step portion 64 and the facing member 37*d* is smaller than the shortest distance L1 between the facing member 37*d* and the bottom surface of the second flow path portion 61*b*. As such, it is difficult for the small creature C to pass through between the step portion 64 and the facing member 37*d*. Accordingly, it is possible to further suitably suppress the small creature C from entering to the inside of the mechanical room 30*b*. The distance L4 for example, is greater than or equal to 1 mm, and less than or equal to 30 mm.

Second Embodiment

Figure 17:
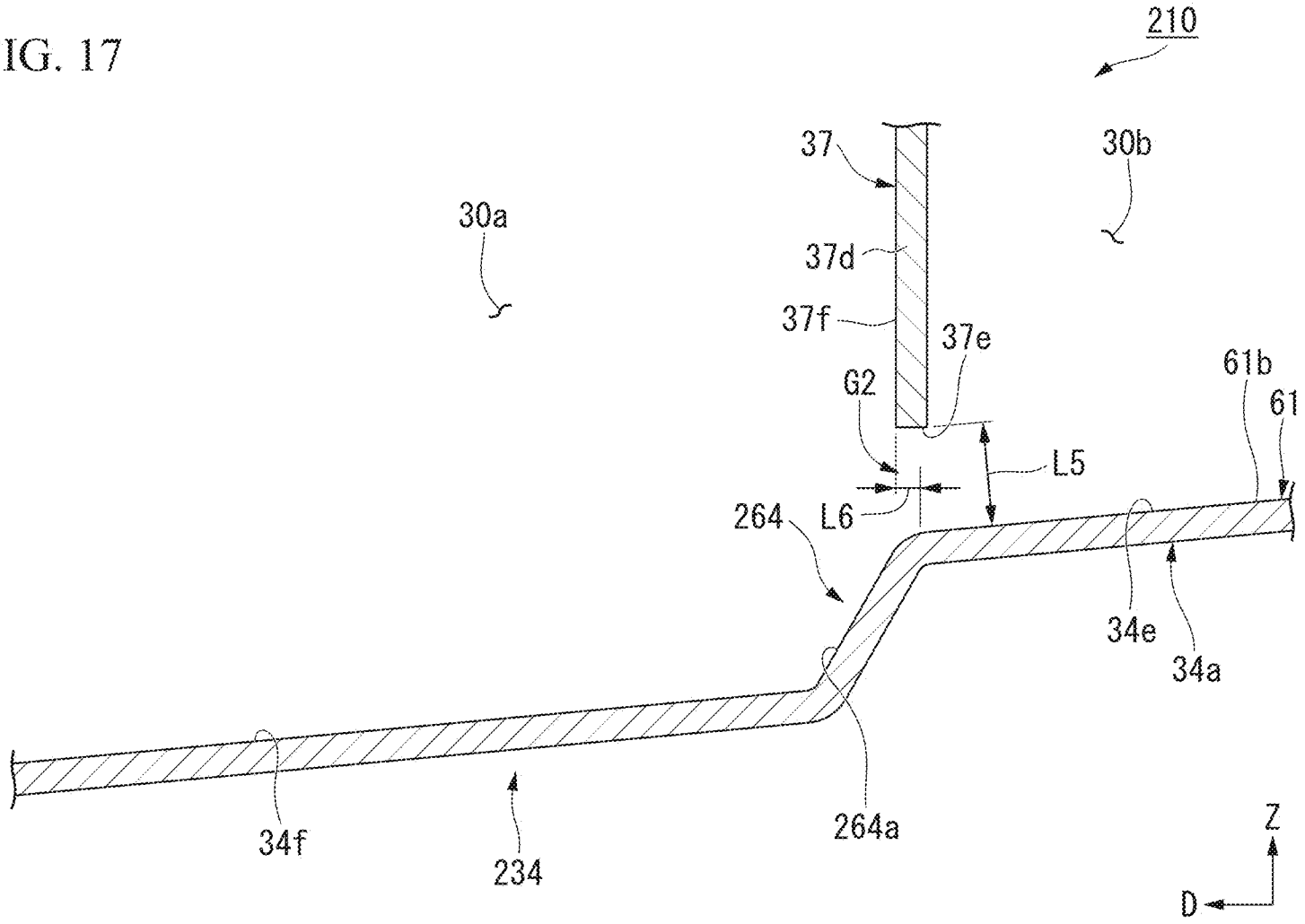
FIG. 17 A cross-sectional view that shows a portion of the bottom plate and a portion of the partitioning member, in a second embodiment.
Figure 18:
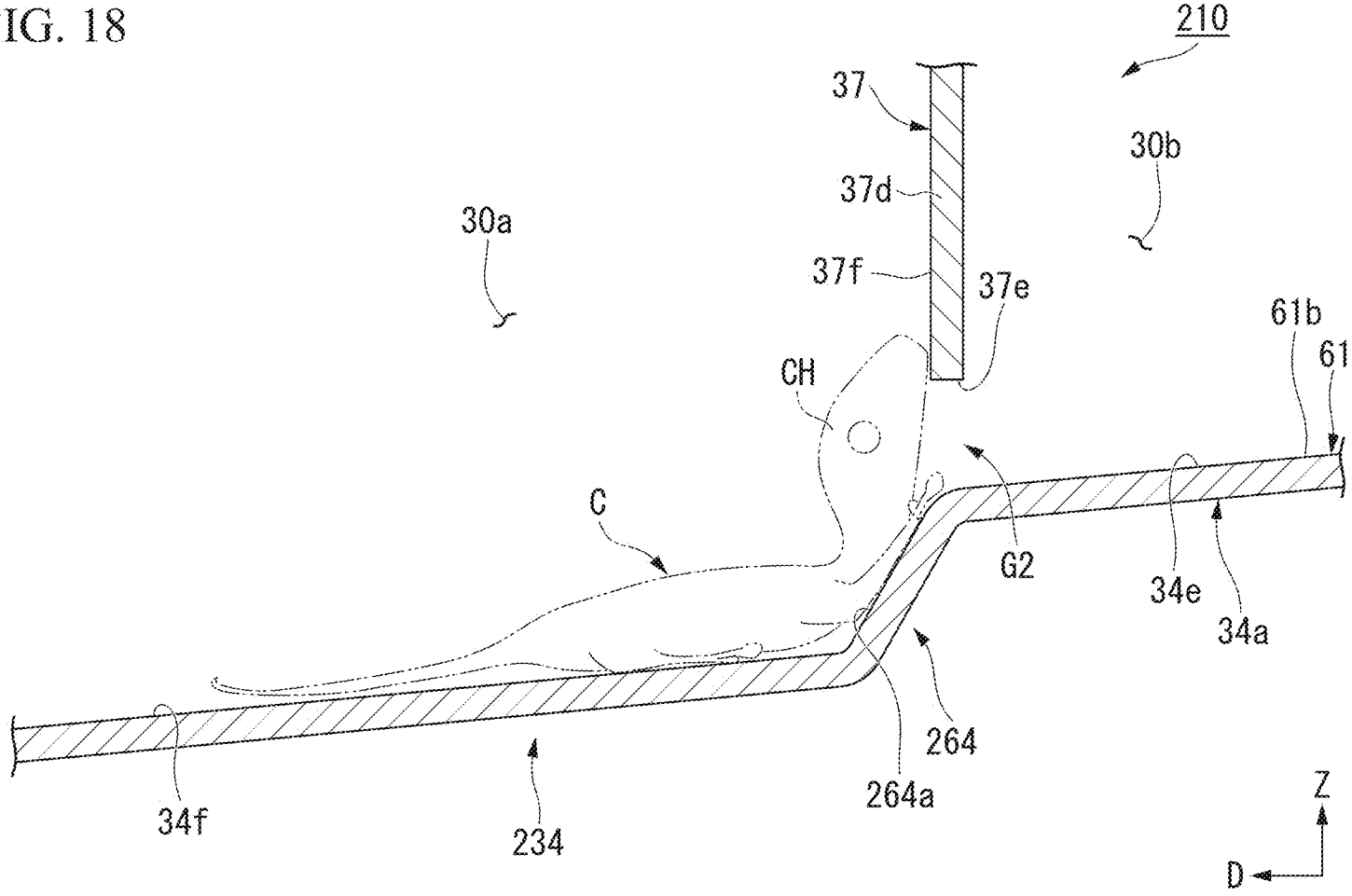
FIG. 18 A view that explains effects of the second embodiment.

FIG. 17 is a cross-sectional view that shows a portion of a bottom plate 234 and a portion of the partitioning member 37, in a second embodiment. FIG. 18 is a view that explains effects of the second embodiment. In the explanations below, configurations similar to the configurations previously mentioned have the same reference signs and the like affixed thereto, with explanations thereof being omitted.

As shown in FIG. 17, on an outdoor unit 210 of the second embodiment, a location in the extension direction D of a step portion 264 with respect to the facing member 37*d* of the partitioning member 37, differs from a location corresponding thereto on the outdoor unit 10 of the first embodiment. The step portion 264 in the second embodiment is formed on a portion located on the inside of the blower room 30*a* out of the bottom surface of the second flow path portion 61*b*. The phrase "the step portion 264 in the second embodiment is formed on a portion located on the inside of the blower room 30*a* out of the bottom surface of the second flow path portion 61*b*" is not limited to an entirety of the step portion 264 being formed on a portion located on the inside of the blower room 30*a* out of the outer surface of the second flow path portion 61*b*, and includes a part of the step portion 264 being located on the bottom side of the facing member 37*d*, while another part of the step portion 264 is formed on a portion that is located on the inside of the blower room 30*a*, out of the bottom surface of the second flow path portion 61*b*. In the second embodiment, an end of the top side of the step portion 264, in other words, an end on the top side of a step surface 264*a* is located on the bottom side of the facing member 37*d*, and parts other than an end on the top side out of the step portion 264 are formed on a portion located on the inside of the blower room 30*a*, out of the bottom surface of the second flow path portion 61*b*. Other than an aspect of a relative location in the extension direction D with respect to the facing member 37*d* being different, the step portion 264 is the same configuration as the configuration of the step portion 64 of the first embodiment.

An end on the top side of the step portion 264 in the second embodiment is disposed on the bottom side of the end 37*e* of the bottom side of the facing member 37*d*, having a gap G2 therebetween. In other words, in the second embodiment, a portion of the step portion 264 is located on the bottom side in the vertical direction of the facing member 37*d*. A side surface 37*f* that faces the end on the top side of the step portion 264 and the inside of the blower room 30*a* out of the facing member 37*d*, is disposed at approximately the same location in the extension direction D as the end on the top side of the step portion 264. In FIG. 17 for example, the side surface 37*f* is slightly located in the downstream side (+D side), more than the end on the top side of the step portion 264. The side surface 37*f* may be located in the upstream side (−D side) more than the end on the top side of the step portion 264. A distance L6 in the extension direction D, between the facing member 37*d* and the end on the top side of the step portion 264 is smaller than a shortest distance L5 between the facing member 37*d* and the bottom surface of the second flow path portion 61*b*. The shortest distance L5 is the shortest distance between the upstream bottom surface 34*e* and the end 37*e* of the bottom side of the facing member 37*d*. The shortest distance L5 is a dimension of the gap G2 in a direction orthogonal to the upstream bottom surface 34*e*. The shortest distance L5 is for example, greater than or equal to 1 mm, and less than or equal to 30 mm. In the example of FIG. 17, although the distance L6 is larger than zero, the distance L6 may be equal to zero. The distance L6 is for example, greater than or equal to 0 mm, and less than or equal to 30 mm.

Other configurations of the bottom plate 234 are the same as other configurations of the bottom plate 34 of the first embodiment. Other embodiments of the outdoor unit 210 are the same as other embodiments of the outdoor unit 10 of the first embodiment.

According to the second embodiment, the step portion 264 is formed on a portion that is located on the inside of the blower room 30*a*, out of the bottom surface of the second flow path portion 61*b*. As such, as shown in FIG. 18, before going through the gap G2, the small creature C that enters to the inside of the blower room 30*a* contacts the step surface 264*a* of the step portion 264 provided in the vicinity of the facing member 37*d*, when trying to move to the inside of the mechanical room 30*b* by going through the gap G2. The head CH thereof, which comes into contact with the step surface 264*a* of the step portion 264 is made to face the top side along the step surface 264*a*, and a direction in which the creature C is moving in changes to the top side. At such time, since the side surface 37*f* of the facing member 37*d* that is located ahead in the direction of motion seems like a floor surface, as seen by the small creature C, it is easier for the small creature C to straddle over the gap G2 and continue on to the side surface 37*f*. Accordingly, the creature C is suppressed from entering through the gap G2. Therefore, it is possible to suitably suppress the small creature C from entering to the inside of the mechanical room 30*b*.

The distance L6 in the extension direction D between the side surface 37*f* and the end on the top side of the step portion 264 is small enough, compared to the size of the gap G2, in other words the shortest distance L5, and it is preferable the distance L6 be zero. The above is done so as to make it easier for the side surface 37*f* of the facing member 37*d* to look like a floor surface, as seen from the creature C, of which the head CH thereof faces the top side along the step portion 264, after coming into contact with the step portion 264. For example, when the distance L6 is large and the side surface 37*f* is on the downstream side (+D side), more than the end on the top side of the step portion 264, it is easier to have the end 37*e* of the bottom side of the facing member 37*d* be located on a front end of a gaze of the creature C having the head CH thereof made so as to face the top side along the step portion 264, and a risk of having the small creature enter through the gap G2 become easier exists. As another example, when the dimension L6 is large and the side surface 37*f* is on the upstream side (−D side) more than an end on the top side of the step portion 264, there is a risk of it becoming easier for the creature C to go over the step portion 264, and for the head CH thereof to face a direction along the upstream bottom surface 34*e*. As such, it is easier for the gap G2 to be seen from the front end of the gaze of the creature C, and there is a risk of it becoming easier for the creature C to enter into the gap G2.

According to the second embodiment, a part of the step portion 264 is located on the bottom side in the vertical direction of the facing member 37*d*. As such, it is possible to provide the facing member 37*d* and the step portion 264 so as to be suitably close to one another. Therefore, it is possible to more suitably make a structure where it is difficult for small creatures to enter to the inside of the mechanical room 30*b* from the inside of the blower room 30*a*, using the facing member 37*d* and the step portion 264.

Although various embodiments of the present disclosure are described above, the present disclosure is not limited to configurations of each of the embodiments thereof, and it is possible to adopt the configurations and/or methods mentioned below.

A drain water flow path portion (first drain water flow path portion 61) formed so as to straddle between a bottom of a first room (blower room 30*a*) and a bottom of a second room (mechanical room 30*b*), may extend from the second room towards a drain water hole or the like in any manner. Said drain water flow path portion may extend towards the drain water hole and may connect with the drain water hole, after extending towards a direction that moves away from the drain water hole. A bottom surface of said drain water hole need not be inclined with respect to a plane that is orthogonal to the vertical direction Z. Even in such case, water that continually flows to an inside of said drain water flow path pushes and discharges water on the inside of the drain water flow path, to an outside of an outdoor unit. The drain water flow path is for example, formed using the frame 34*b* of the bottom plate 34 in the first embodiment mentioned above. A bottom of a housing of the outdoor unit may be molded out of resin. The drain water flow path may be formed as the bottom of the housing of the outdoor unit is resin molded. A number of the drain water holes that are formed on the bottom of the first room may be greater than or equal to two.

So long as a step portion is formed on a bottom surface of an inbetween flow path portion (second flow path portion 61*b*) located between a pair of supports, the portion thereof may be disposed in any corresponding location with respect to a facing member. The step portion may be formed on a portion that faces the bottom side in the vertical direction of the facing member, out of the bottom surface of the narrow flow path. The step portion is formed so as to straddle a portion located on an inside of the first room (blower room 30*a*) and a portion located on an inside of the second room (mechanical room 30*b*). In such case, the step portion has a portion located on the bottom side in the vertical direction of the facing member, a portion that is formed on a portion that is located on the inside of the first room (blower room 30*a*) out of the bottom surface of the narrow flow path, a portion that is formed on a portion that is located on the inside of the second room (mechanical room 30*b*) out of the bottom surface of the narrow flow path. An entirety of the step portion may be located on the bottom side in the vertical direction of the facing member. A height of the step portion is not particularly limited. So long as it is possible for water to pass through, a size of a gap between the bottom surface of the narrow flow path and the facing member is not particularly limited.

The refrigeration cycle device of the present disclosure is any device that utilizes a refrigeration cycle that circulates a refrigerant, and is not particularly limited to an air conditioner. The refrigeration cycle device may be a heat pump of a water heater or the like. The various configurations and various methods explained in the above specification may be combined as needed, so long as no conflicts in the technical scope thereof occurs.

The invention claimed is:

1. An outdoor unit of a refrigeration cycle device comprising:

a housing having a first room and a second room that are partitioned from one another by a partition;

a heat exchanger disposed on an inside of the first room;

a blower that is disposed on the inside of the first room, and controlling circuitry that is disposed on an inside of the second room, wherein on a bottom of the housing a drain water hole that is formed on a bottom of the first room;

a drain water flow path portion that is connected to the drain water hole, and that is formed so as to straddle between the bottom of the first room and the bottom of the second room, and a pair of supports that support the partition from a bottom side in a vertical direction, are formed on a bottom of the housing, the drain water flow path portion has an inbetween flow path portion that is located between the pair of supports, the partition has a protrusion that faces a bottom surface of the inbetween flow path portion via a gap on a top side in the vertical direction, a step portion is formed on a bottom surface of the inbetween flow path portion so as to have a side that is farther from the drain water hole be higher than a side that is closer to the drain water hole, in an extension direction in which the inbetween flow path portion extends in, as seen from the top side in the vertical direction, and a flow path width of the inbetween flow path portion is smaller than a maximum flow path width that is connected to a downstream side of the inbetween flow path portion, out of the drain water flow path portion, and a flow path width that is connected to an upstream side of the inbetween flow path portion, out of the drain water flow path portion.

2. The outdoor unit according to claim 1, wherein the step portion is formed on a portion located on the inside of the second room, out of the bottom surface of the inbetween flow path portion.

3. The outdoor unit according to claim 2, wherein a height of the step portion is greater than or equal to half a shortest distance between the protrusion and the bottom surface of the inbetween flow path portion.

4. The outdoor unit according to claim 3, wherein the height of the step portion is larger than shortest distance between the protrusion and the bottom surface of the inbetween flow path portion.

5. The outdoor unit according to claim 2, wherein a distance in the extension direction, between an end on a bottom side in the vertical direction of the step portion and the protrusion, is smaller than a shortest distance between the protrusion and the bottom surface of a second flow path portion.

6. The outdoor unit according to claim 2, wherein a distance in the extension direction, between an end on the top side in the vertical direction of the step portion and the protrusion, is smaller than a shortest distance between the protrusion and the bottom surface of a second flow path portion.

7. The outdoor unit according to claim 1, wherein the step portion is formed on a portion located on the inside of the first room, out of the bottom surface of the inbetween flow path portion.

8. The outdoor unit according to claim 1, wherein a part of the step portion is located on the bottom side in the vertical direction of the protrusion.

9. The outdoor unit according to claim 1, wherein a bottom surface of the drain water flow path portion is located to the bottom side as the bottom surface of the drain water flow path portion approaches the drain water hole.

10. A refrigeration cycle device comprising:

the outdoor unit according to claim 1, and an indoor unit.

* * * * *